US007147025B2

(12) United States Patent
Kitora

(10) Patent No.: US 7,147,025 B2
(45) Date of Patent: Dec. 12, 2006

(54) IMAGE FORMING APPARATUS CAPABLE OF COUNTING CONSUMABLE CONSUMPTION AMOUNT, AND CONTROL METHOD AND CONTROL PROGRAM THEREFOR

(75) Inventor: Masakazu Kitora, Kanagawa (JP)

(73) Assignee: Canon Kabushiki Kaisha (JP)

( * ) Notice: Subject to any disclaimer, the term of this patent is extended or adjusted under 35 U.S.C. 154(b) by 171 days.

(21) Appl. No.: 10/941,177

(22) Filed: Sep. 15, 2004

(65) Prior Publication Data

US 2005/0063717 A1 Mar. 24, 2005

(30) Foreign Application Priority Data

Sep. 19, 2003 (JP) ..... 2003-329136

(51) Int. Cl.
*G03G 15/08* (2006.01)
*G03G 15/10* (2006.01)

(52) U.S. Cl. ..... 152/415; 399/27; 399/60; 399/72

(58) Field of Classification Search ..... 152/415; 399/24, 27, 43, 45, 49, 60, 72
See application file for complete search history.

(56) References Cited

U.S. PATENT DOCUMENTS 6,075,954 A * 6/2000 Ogata et al. ..... 399/60
6,708,007 B1 * 3/2004 Yamaguchi ..... 399/30
6,947,677 B1 * 9/2005 Uyama et al. ..... 399/27

FOREIGN PATENT DOCUMENTS

JP 5-323791 A 12/1993

* cited by examiner

*Primary Examiner*—Hoang Ngo
(74) *Attorney, Agent, or Firm*—Rossi, Kimms & McDowell LLP

(57) ABSTRACT

An image forming apparatus which is capable of accurately performing a video count process based on image data and thus maintaining the quality of images even where DMA transfer processing is used. An image forming device performs a process using a consumable material. A first controller controls the image forming device. A transfer controller provides control to transfer externally input image data to the first controller. A second controller performs a count process for counting an amount of the consumable material to be consumed based on the image data transferred by the transfer controller. The second controller disables the count process without stopping the transfer by the transfer controller when the process performed by the image forming device is interrupted.

11 Claims, 25 Drawing Sheets

CONTROLLER
1001
2205
2207
DRIVER
LOAD
2204
I/O
SENSOR
2206
SERIAL BUS
IMAGE DATA
PRINTER ENGINE CONTROLLER
2200
RAM
2203
SCI
2209
ROM
2202
IMAGE PROCESSOR
2210
FIXING TEMPERATURE SENSOR
2208
CPU
2201
IMAGE DATA
3
EXPOSURE OPTICAL SYSTEM

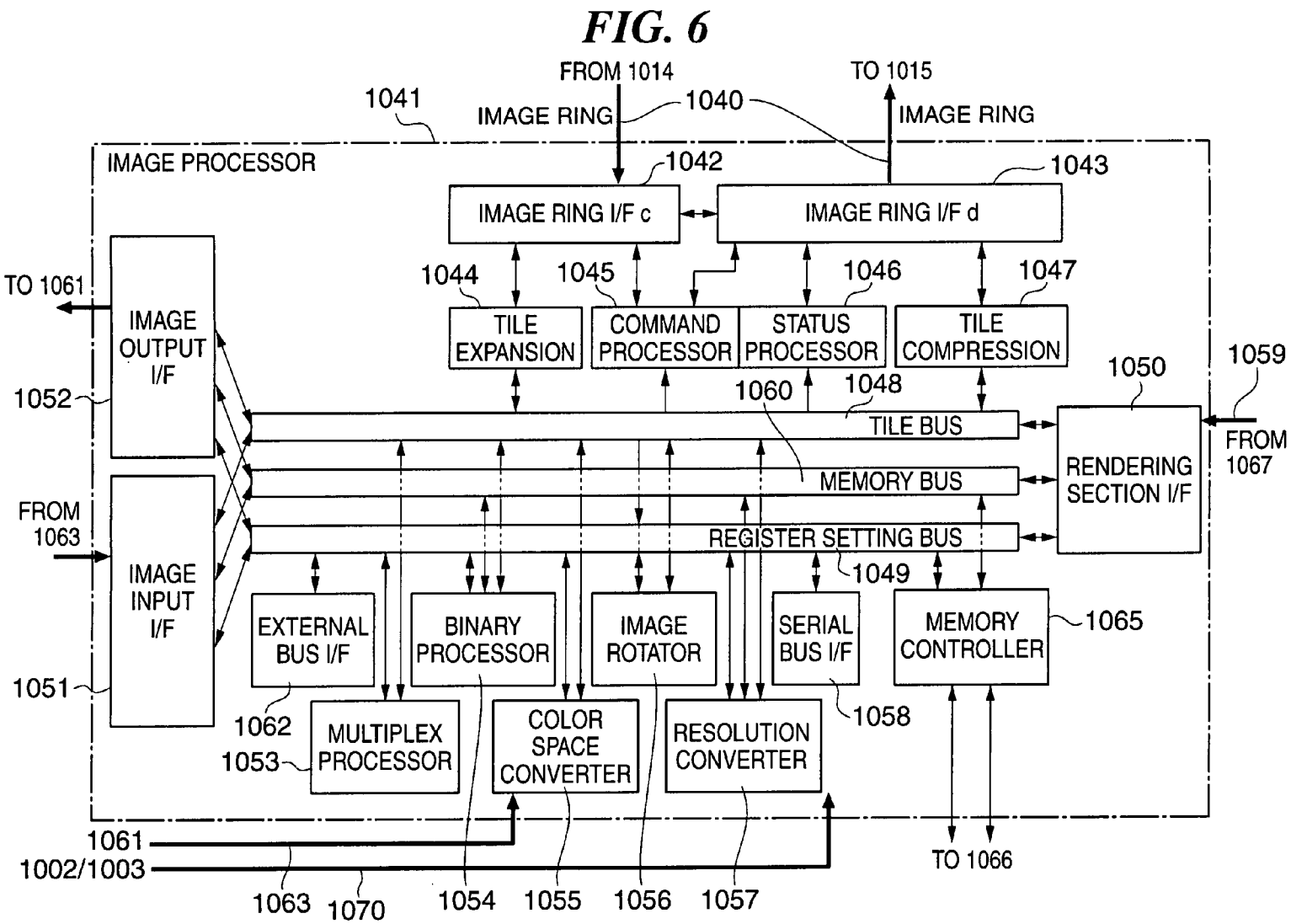
FIG. 6
IMAGE PROCESSOR
1041
FROM 1014
IMAGE RING
1040
TO 1015
IMAGE RING
IMAGE RING I/F c
1042
IMAGE RING I/F d
1043
TILE EXPANSION
1044
COMMAND PROCESSOR
1045
STATUS PROCESSOR
1046
TILE COMPRESSION
1047
TILE BUS
1048
MEMORY BUS
1060
REGISTER SETTING BUS
1049
RENDERING SECTION I/F
1050
1059
FROM 1067
MEMORY CONTROLLER
1065
TO 1066
SERIAL BUS I/F
1058
RESOLUTION CONVERTER
1057
IMAGE ROTATOR
1056
COLOR SPACE CONVERTER
1055
BINARY PROCESSOR
1054
MULTIPLEX PROCESSOR
1053
EXTERNAL BUS I/F
1062
1070
1063
1061
1002/1003
IMAGE OUTPUT I/F
1052
TO 1061
IMAGE INPUT I/F
1051
FROM 1063

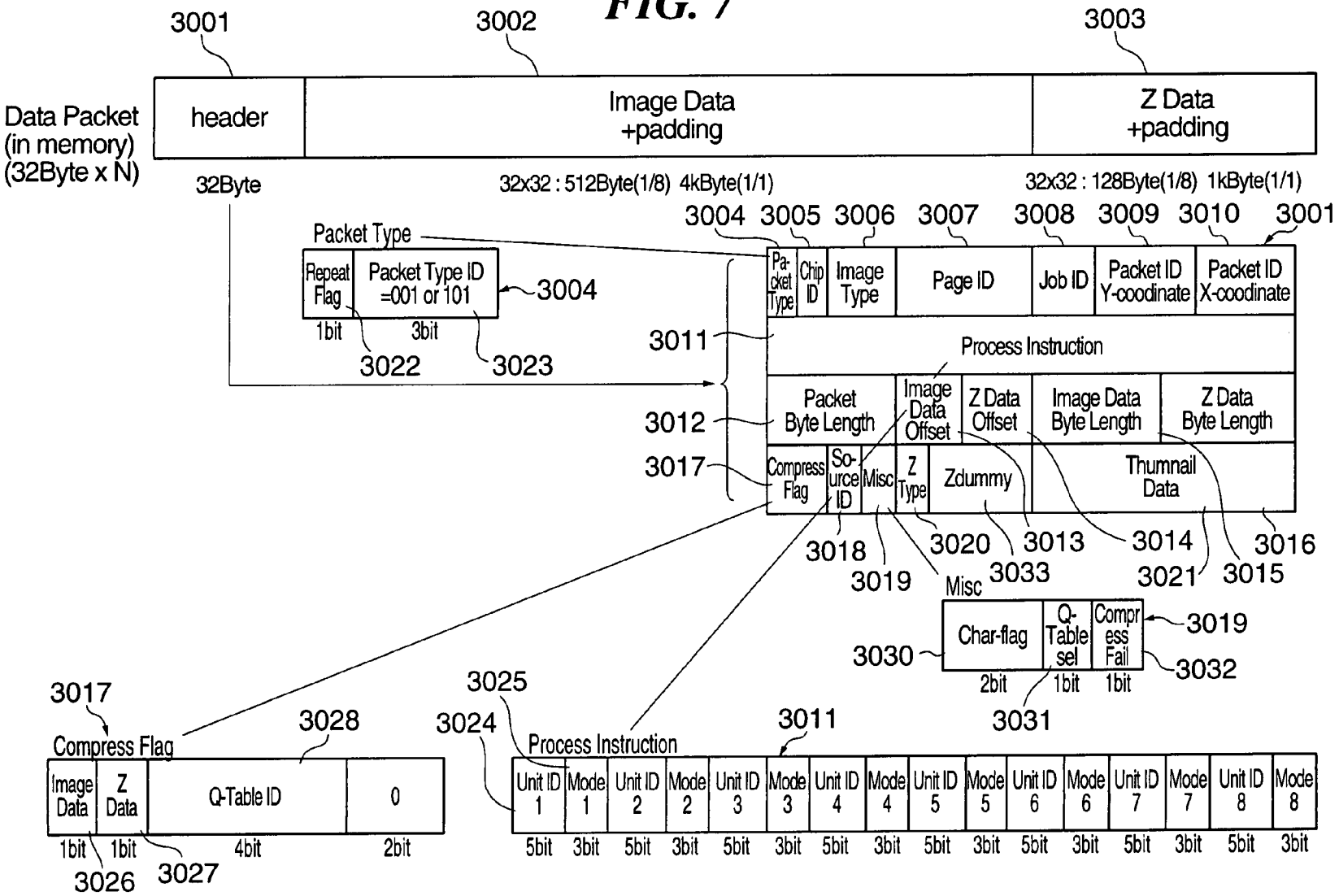
FIG. 7
Data Packet (in memory) (32Byte x N)
3001
header
3002
Image Data +padding
3003
Z Data +padding
32Byte
32x32 : 512Byte(1/8) 4kByte(1/1)
32x32 : 128Byte(1/8) 1kByte(1/1)
3004 3005 3006 3007 3008 3009 3010 3001
Packet Type
Chip ID
Image Type
Page ID
Job ID
Packet ID Y-coodinate
Packet ID X-coodinate
Process Instruction
Packet Type ID =001 or 101
Repeat Flag
1bit
3bit
3022
3023
3011
3012
3017
Compress Flag
Packet Byte Length
Source ID
Misc
Z Type
Image Data Offset
Z Data Offset
Zdummy
Image Data Byte Length
Thumnail Data
Z Data Byte Length
3018
3019
3020
3013
3014
3015
3016
3021
3033
Misc
Char-flag
Q-Table sel
Compress Fail
2bit
1bit
3030
3031
3032
3019
Unit ID
Mode
5bit
3bit
Process Instruction
3024
3025
Compress Flag
Image Data
Z Data
1bit
3026
3027
Q-Table ID
4bit
0
2bit
3028
3017

| FIG.15 | |
|---|---|
| FIG.15A | FIG.15B |

| FIG.20 | |
|---|---|
| FIG.20A | FIG.20B |

IMAGE FORMING APPARATUS CAPABLE OF COUNTING CONSUMABLE CONSUMPTION AMOUNT, AND CONTROL METHOD AND CONTROL PROGRAM THEREFOR

BACKGROUND OF THE INVENTION

1. Field of the Invention

The present invention relates to an image forming apparatus capable of counting a consumable consumption amount, and a control method and a control program therefor, and more particularly, to an image forming apparatus, control method, and control program that measure a consumption amount of a consumable material used in the image forming process.

2. Description of the Related Art

In electrophotographic and electrostatic image forming apparatuses in general, the toner density of a two-component developing agent comprised of a carrier and a toner, that is, the ratio of the weight of the toner particles to the total weight of the carrier particles and toner particles, is an extremely important factor in stabilizing the quality of images. During development, of the developing agent only the toner particles are consumed whereas the carrier particles are not consumed, and therefore the toner density decreases as the developing process proceeds. As a result, it is necessary to use a toner density controller (that is, an ATR, or Automatic Toner Replenisher) in order to accurately detect developing agent toner density and to replenish toner particles depending on the decrease in toner density as suitable, so as to continuously maintain the toner density at a constant level and thus maintain the quality of images.

Conventionally, devices employing a variety of methods have been implemented, such as toner density detection devices and toner density control devices that correct changes in toner density inside a developing device.

Such methods include a method of detecting the toner density from the reflectance of the developing agent when light is irradiated onto either the developing agent conveyed by the developing device to a development sleeve or the developing agent inside a developing agent container of the developing device, a permeability detecting method, and a method of controlling the toner density indirectly from a patch image density.

However, the method of detecting the toner density from the reflectance of the developing agent suffers from a problem that it becomes impossible to accurately detect the toner density if a photosensor used to detect the toner density has become soiled by toner spatter or the like.

Moreover, the ATR employing the permeability detecting method suffers from a problem that a sensor output signal corresponding to the apparent permeability (inductance) changes discontinuously, and it becomes impossible to accurately detect the toner density if there is a change in the apparent density of the developing agent due to neglect of the developing agent or there are environment changes between just before stopping operation of the image forming apparatus and just after restarting operation of the image forming apparatus.

Moreover, the method of controlling toner density indirectly from a patch image density has the disadvantage that, as image forming apparatuses have become more compact, it has become impossible to secure either the space needed to install a patch density sensor inside the image forming apparatus or the space needed to form the patch image on the development sleeve.

To solve the problems described above, a toner replenishment method using a video count process has been implemented (see Japanese Laid-Open Patent Publication (Kokai) No. H05-323791).

According to this toner replenishment method, the video count process is performed in which the output level of each pixel of a digital image signal (image density signal) is converted into a signal indicative of a toner consumption amount and these toner consumption amount signals are counted and accumulated (the accumulated value will be referred to as "the video count value"). After the video count process, the amount of toner to be consumed is calculated from a print level ratio of the output image to thereby replenish the developing agent container with toner as appropriate. In other words, the video count value is converted into a toner replenishment amount and toner in that replenishment amount is supplied to the developing agent container, thus maintaining the toner density inside the developing agent container, which decreases with development, at a constant level.

On the other hand, Multi Function Printers (MFPs) equipped with copier, facsimile and printer capabilities have become widely used. Typically, such MFPs are comprised of a controller, which performs image processing based on input data from an external source, and an engine, which includes an engine controller that performs image formation processing (that is, recording by a recording section) based on image-processed data supplied from the controller.

The controllers of such MFPs have become very sophisticated. Moreover, to reduce the cost of the engine or for some other reason, such controllers are sometimes equipped with image processors that perform a variety of types of image processing.

Moreover, the controller is sometimes equipped with hardware dedicated to a specific process. For example, to transfer image data to the engine, a typical controller is provided with hardware employing DMA (Direct Memory Access) transfer, which is capable of high-speed processing.

Further, it can be envisaged that the controller will eventually be configured so as to perform a video count of image data that is transferred to the engine.

However, having the controller perform the video count process involves several problems.

For example, image data continues to be transferred even if the image forming process performed by the engine stops in the middle of a page, and therefore incorrect consumption count of the consumable material, i.e. the developing agent is performed based on the video count value of the transferred image data despite the fact that no consumable material has been consumed because image forming means including the engine has stopped.

Further, for example, if the controller has been interrupted a requested image transfer process by the DMA transfer due to the occurrence of a malfunction such as a jam, an exclusive process or a failsafe process for determining at what timing the DMA transfer been interrupted and from where the recovery is to be started is performed. To prevent such exclusive process or failsafe process from being performed, it is necessary to make the software more complicated, but doing so increases the probability of bugs arising and decreases the performance of the overall system.

Further, even where the DMA transfer is not used, if a printing process is performed in synchronism with a scanning process, the image transfer cannot be stopped midway and the same problems as described above arise.

SUMMARY OF THE INVENTION

It is an object of the present invention to provide an image forming apparatus, and a control method and control program therefor, which are capable of accurately performing a video count process based on image data and thus maintaining the quality of images even where DMA transfer processing is used.

To attain the above object, in a first aspect of the present invention, there is provided an image forming apparatus comprising an image forming device that performs a process using a consumable material, a first controller that controls the image forming device, a transfer controller that provides control to transfer externally input image data to the first controller, and a second controller that performs a count process for counting an amount of the consumable material to be consumed based on the image data transferred by the transfer controller, wherein the second controller disables the count process without stopping the transfer by the transfer controller when the process performed by the image forming device is interrupted.

Preferably, the second controller sets predetermined fixed value data as data to be transferred by the transfer controller in place of the input image data to inhibit the count process based on the input image data from being performed.

More preferably, the fixed value data comprises data corresponding to white.

Preferably, the image forming apparatus further comprises a storage device, and a notifying device, and the second controller separately counts amounts of the consumable material to be consumed corresponding respectively to a plurality of color image data based on the input image data, the storage device stores the separately counted amounts of the consumable material to be consumed corresponding respectively to the plurality of color image data, and the notification device notifies the first controller of the amounts of the consumable material to be consumed stored in the storage device when the process performed by the image forming device is interrupted.

Preferably, the image forming apparatus further comprises a halftone processing device that performs different halftone processes depending on a type of the input image data, and the second controller counts the amount of the consumable material to be consumed based on a selected one of the halftone processes and the image data transferred by the transfer controller.

More preferably, the second controller switches the halftone processes based on characteristic information that changes with each pixel of the image data transferred by the transfer controller.

Preferably, the image forming apparatus further comprises a notification device that notifies the first controller of results of the count process performed by the second controller, and the first controller performs a consumable material replenishment process based on the notification by the notification device.

Preferably, the image forming apparatus further comprises an image processing device that performs image processing on the externally input image data, and the second controller counts the amount of the consumable material to be consumed based on the externally input image data before being subjected to the image processing by the image processing device.

More preferably, the image processing device comprises an adjustment device that corrects image data based on environment, and the second controller counts the amount of the consumable material to be consumed based on the externally input image data before being subjected to the correction by the adjustment device.

Preferably, the image forming device comprises a printer engine, and the first controller controls the printer engine, and the second controller supplies image data to the printer engine.

Preferably, the transfer controller transfers the image data by DMA (Direct Memory Access) transfer.

To attain the above object, in a second aspect of the present invention, there is provided an image forming apparatus comprising an image forming device that performs an image forming process using a consumable material, a transfer device that transfers externally input image data to the image forming device, and a disable device operable when the image forming process by the image forming device is interrupted during execution of a count process for counting an amount of the consumable material to be consumed based on the image data transferred by the transfer device, to disable the count process without stopping the transfer of the image data by the transfer device.

To attain the above object, in a third aspect of the present invention, there is provided a control method for an image forming apparatus, comprising a first control step of causing a controller to control a process using a consumable material which is performed by an image forming device, a transfer control step of transferring externally input image data to the controller, and a second control step of performing a count process for counting an amount of the consumable material to be consumed based on the image data transferred in the transfer control step, wherein in the second control step, the count process is disabled without stopping the transfer in the transfer control step when the process performed by the image forming device is interrupted.

Preferably, in the second control step, predetermined fixed value data is set as data to be transferred in the transfer control step, in place of the input image data to inhibit the count process based on the input image data from being performed.

More preferably, the fixed value data comprises data corresponding to white.

Preferably, in the second control step, amounts of the consumable material to be consumed corresponding respectively to a plurality of color image data based on the input image data are separately counted, and the control method further comprises a storage step of storing the separately counted amounts of the consumable material to be consumed corresponding respectively to the plurality of color image data in a storage device, and a notification step of notifying the controller of the amounts of the consumable material to be consumed stored in the storage device when the process performed by the image forming device is interrupted.

Preferably, the control method further comprises a halftone processing step of performing different halftone processes depending on a type of the input image data, and in the second control step, the amount of the consumable material to be consumed is counted based on a selected one of the halftone processes and the image data transferred in the transfer control step.

More Preferably, in the second control step, the halftone processes are switched based on characteristics information that changes with each pixel of the image data transferred in the transfer control step.

Preferably, the control method further comprises a notification step of notifying the controller of results of the count process performed in the second control step, and in the first control step, a consumable material replenishment process is performed based on the notification in the notification step.

Preferably, the control method further comprises an image processing step of performing image processing on the externally input image data, and in the second control step, the amount of the consumable material to be consumed is counted based on the externally input image data before being subjected to the image processing in the image processing step.

Preferably, the image processing step comprises an adjustment step of correcting image data based on environment, and in the second control step the amount of the consumable material to be consumed is counted based on the externally input image data before being subjected to the correction in the adjustment step.

Preferably, in the first control step, a printer engine is controlled, and in the second control step image data is supplied to the printer engine.

Preferably, in the transfer control step, the image data is transferred by DMA (Direct Memory Access) transfer.

To attain the above object, in a fourth aspect of the present invention, there is provided a control method for an image forming apparatus including an image forming device that performs an image forming process using a consumable material, the control method comprising a transfer step of transferring externally input image data to the image forming device, and a disable step of disabling, when the image forming process by the image forming device is interrupted during execution of a count process for counting an amount of the consumable material to be consumed based on the image data transferred in the transfer step, the count process without stopping the transfer of the image data in the transfer step.

To attain the above object, in a fifth aspect of the present invention, there is provided a control program executed by a second controller of an image forming system having a first controller, the second controller, and an image forming device that performs a process using a consumable material, wherein the first controller controls the image forming device, and the second controller transfers externally input image data to the first controller and performs a count process for counting an amount of the consumable material to be consumed based on the transferred image data, the control program comprising a module for disabling the count process without stopping the transfer of the image data by the second controller when the process performed by the image forming device is interrupted.

To attain the above object, in a sixth aspect of the present invention, there is provided a control program executed by a supply controller of an image forming apparatus, wherein the image forming apparatus has an image forming device that performs an image forming process on image data using a consumable material, and the supply controller that supplies image data on which the image forming process is to be performed by the image forming device, the control program comprising a transfer module for transferring externally input image data to the image forming device, and an disable module for disabling, when the image forming process by the image forming device is interrupted during execution of a count process for counting an amount of the consumable material to be consumed based on the image data transferred by the transfer module, the count process without stopping the transfer of the image data by the transfer module.

According to the first aspect to the sixth aspect of the present invention, the video count processing based on image data can be performed accurately even where the DMA transfer processing is used.

The above and other objects, features and advantages of the invention will become more apparent from the following detailed description taken in conjunction with the accompanying drawings.

BRIEF DESCRIPTION OF THE DRAWINGS

FIG. 6 is a block diagram showing in detail the configuration of an image processor appearing in FIG. 4;

FIG. 7 is a diagram useful in explaining the format of a data packet including image data;

DETAILED DESCRIPTION OF THE PREFERRED EMBODIMENTS

The present invention will now be described in detail with reference to the drawings showing preferred embodiments thereof.

Figure 1:
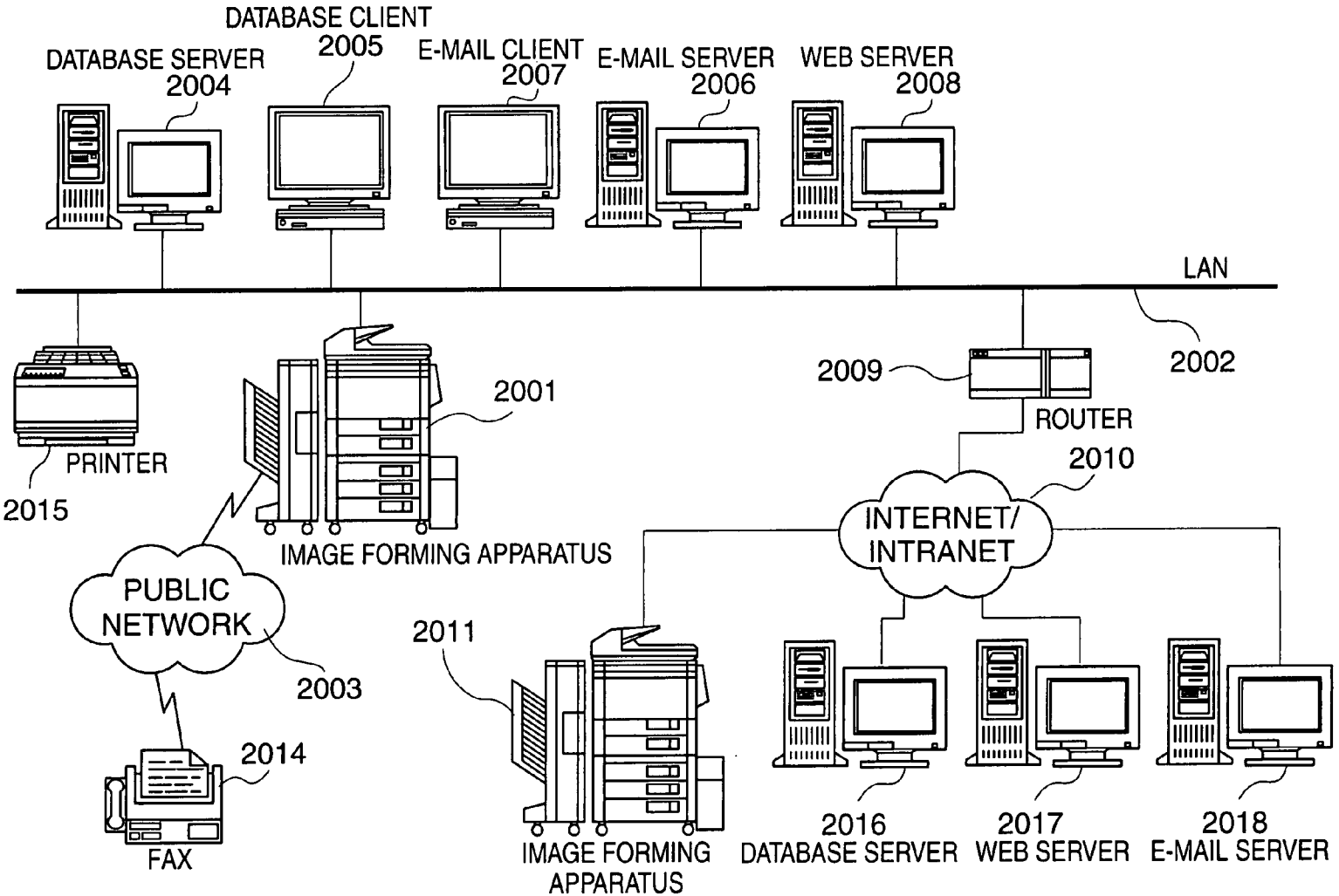
FIG. 1 is a block diagram showing the configuration of a network system including an image forming apparatus according to a first embodiment of the present invention.

FIG. 1 is a block diagram showing the configuration of a network system including an image forming apparatus according to a first embodiment of the present invention.

As shown in FIG. 1, the image forming apparatus 2001 according to the first embodiment is comprised of a scanner section and a printer section, so that image data scanned by the scanner section can be transmitted to a LAN (Local Area Network) 2002 and image data received from the LAN 2002 can be printed out by the printer section. Moreover, the image forming apparatus 2001 sends e image data scanned by the scanner section to a public network 2003 comprised of a PSTN (Public Switched Telephone Network) or an ISDN (Integrated Services Digital Network) via a facsimile transmission/reception section, not shown. Image data received from the public network 2003 can be printed out by the printer section.

A database server 2004 manages binary image data and multivalic image data read in from the image forming apparatus 2001 as a database. A database client 2005 is a client of the database server 2004, and can view and retrieve the image data stored in the database server 2004.

An electronic mail (e-mail) server 2006 can receive image data read by the image forming apparatus 2001 as attachment data to an e-mail. An e-mail client 2007 can receive and view an e-mail received by the e-mail server 2006 as well as transmit an e-mail.

A WWW server (web server) 2008 provides HTML text data to the image forming apparatus 2001 and others via the LAN 2002. HTML text data provided by the WWW sever 2008 can be printed out by the image forming apparatus 2001.

A router 2009 connects the LAN 2002 to the Internet or an intranet 2010. An image forming apparatus 2011, a database server 2016, a WWW server 2017 and an e-mail server 2018 having the same configuration as the image forming apparatus 2001, the database server 2004, the WWW server 2008 and the e-mail server 2006, respectively, are also connected to the Internet or the intranet 2010.

The image forming apparatus 2001 can communicate with a fax machine 2014 via the public network 2003. Moreover, a printer 2015 is also connected to the LAN 2002, and image data read by the scanner section of the image forming apparatus 2001 can also be printed out by the printer 2015.

Figure 2:
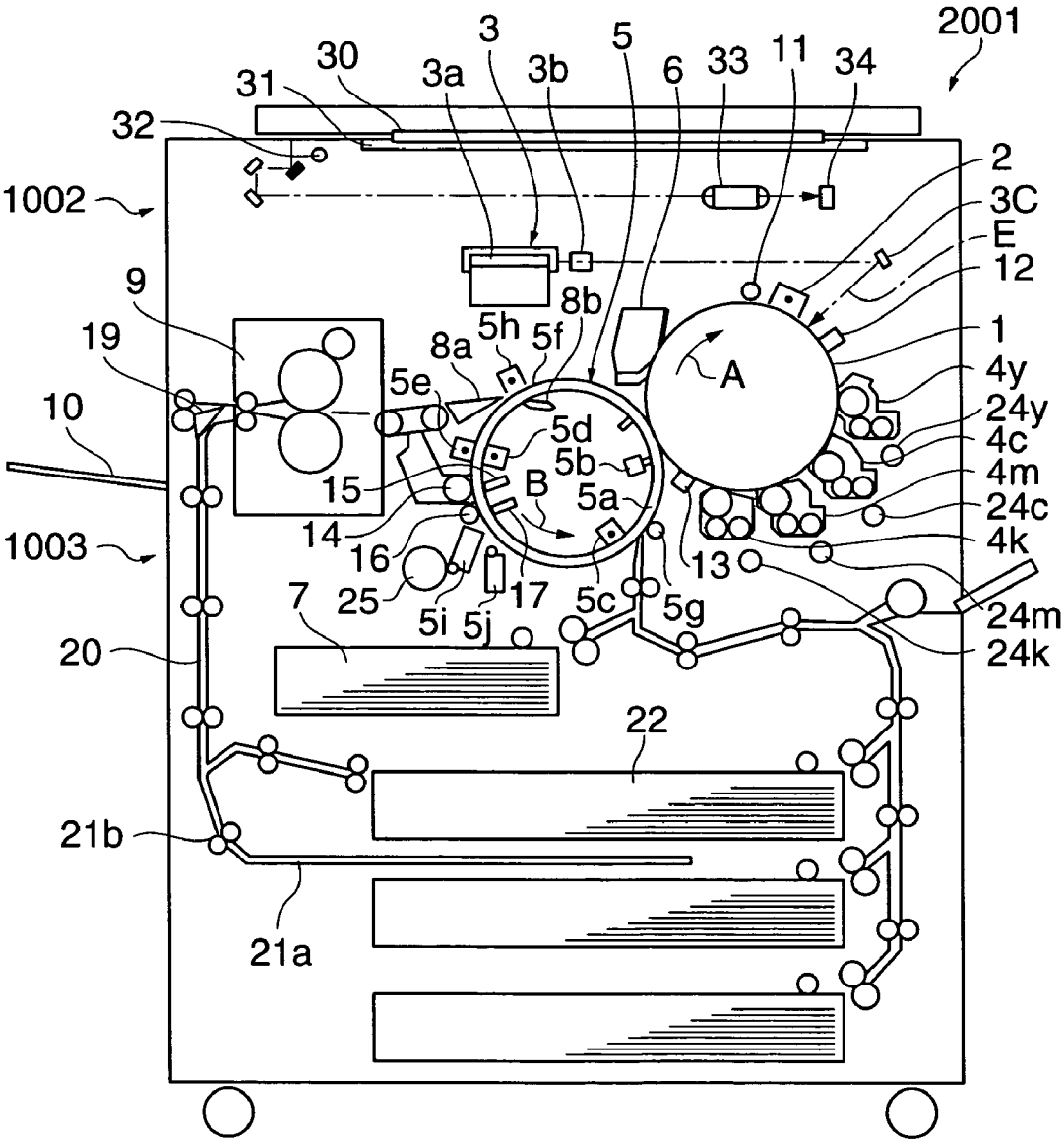
FIG. 2 is a cross-sectional view schematically showing the configuration of the image forming apparatus of FIG. 1.

FIG. 2 is a cross-sectional view schematically showing the configuration of the image forming apparatus 2001 shown in FIG. 1. It should be noted that the image forming apparatus 2011 has exactly the same configuration as the image forming apparatus 2001, and therefore, although the following description is directed to the image forming apparatus 2001, it is to be understood that the description applies equally to the image forming apparatus 2011.

The image forming apparatus 2001 is comprised of a digital color image scanner (hereinafter simply referred to as "the scanner section") 1002 disposed at a top portion of the apparatus 2001, and a digital color image printer (hereinafter simply referred to as "the printer section") 1003 disposed at a bottom portion of the apparatus 2001. The scanner section 1002 and the printer section 1003 are connected to a controller 1001, described later (see FIG. 4), and function as an image data input device and an image data output device, respectively.

At the scanner section 1002, an original 30 placed on an original platen glass 31 is illuminated and scanned by an exposure lamp 32 and a reflected photo image of the original 30 is focused onto a full color sensor CCD (charge coupled device) 34 by a lens 33 and photoelectrically converted by the CCD 34 to generate a color-separated image signal. The color-separated image signal thus generated is transferred to the controller 1001 and subjected to a variety of image processing operations.

Next, a description will be given of the configuration of the printer section 1003 (printer engine).

The printer section 1003 is comprised of a photosensitive drum 1 disposed so as to rotate in a direction indicated by the arrow A shown in FIG. 2, and a pre-exposure lamp 11, a corona charger 2, an exposure optical system 3, an electric potential sensor 12, developing devices 4*y*, 4*c*, 4*m* and 4*k* for respective four colors, Y (yellow), C (cyan), M (magenta) and K (black (Key)), a patch image density sensor 13, a transfer device 5, and a cleaning device 6, which are disposed around the periphery of the photosensitive drum 1.

In the exposure optical system 3, a laser beam (that is, a photo image E) for each separated color is generated based on image data output from a printer engine controller 2200 shown in FIG. 3, referred to later, the laser beam is irradiated onto a polygon mirror 3*a* while being swung transversely of the peripheral surface of the photosensitive drum 1, so as to raster scan the surface of the photosensitive drum 1 in lines. At this time, the laser beam is irradiated onto the photosensitive drum 1 through a lens 3*b* and a mirror 3*c*.

When forming an image, first, the photosensitive drum 1 is rotated in the direction of the arrow A and the following operations are performed with respect to the photosensitive drum 1. That is, after the pre-exposure lamp 11 is actuated to eliminate residual charge of the surface of the photosensitive drum 1, and then the charger 2 is actuated to evenly charge the surface of the photosensitive drum 1, the photo image E for each separated color is emitted to raster scan the surface of the photosensitive drum 1 to form an electrostatic latent image.

Next, the developing devices 4*y*, 4*c*, 4*m* and 4*k* are activated for respective separated colors to develop the electrostatic latent image on the photosensitive drum 1 into a toner image. In the image forming apparatus 2001, a two-component developing agent composed mainly of toner and carrier is used as a developing agent. It should be noted that the developing agent is not limited to such two-component developing agent, and may, for example, be a one-component developing agent composed mainly of toner or ink without the carrier.

The developing devices 4*y*, 4*c*, 4*m* and 4*k* are arranged so as to sequentially approach the photosensitive drum 1 according to the separated colors, through the operations of eccentric cams 24*y*, 24*c*, 24*m* and 24*k*. Further, the transfer device 5 transfers the toner image on the photosensitive drum 1 to a recording material. In this case, the recording material is supplied from a recording material cassette 7 and, in synchronism with the formation of the toner image of a first color of the separated colors, is conveyed to a position where it is brought into contact with the photosensitive drum 1.

The transfer device 5 is comprised of a transfer drum 5*a*, a transfer charger 5*b*, an attachment charger 5*c* for electrostatically attaching a recording material, a pick-up roller 5*g*, an inside charger 5*d*, an outside charger 5*e*, a recording material carrier sheet 5*f* made of a dielectric material, a separation charger 5*h*, and cam followers 5*i* and 5*j*. The transfer drum 5*a* is rotatively driven in a direction indicated by the arrow B shown in FIG. 2, and the recording material carrier sheet 5*f* is applied to the peripheral surface of the transfer drum 5*a*, in the form of a cylinder integral therewith. The recording material carrier sheet 5*f*, which is a dielectric sheet of polycarbonate film or the like, adsorbs up and carries a recording material.

As the transfer drum 5*a* is rotated, the toner image on the photosensitive drum 1 is transferred by the transfer charger 5*b* to the recording material carried by the recording material carrier sheet 5*f*. In a four-color print mode, when the transfer of the toner images of the four colors is finished, the recording material is separated from the recording material carrier sheet 5*f* by the action of a separation flap 8*a*, a separation roller 8*b* and the separation charger 5*h*. Where an image is formed on only one side, the recording material thus separated is then discharged to a tray 10 through a heated roller fixing device 9.

When images are formed on both sides of a recording material, the recording material is conveyed as follows. That is, the recording material, after being subjected to a fixing process by the heated roller fixing device 9, is conveyed to a vertical discharge path 20 by the action of a conveyance path switching guide 19, led once to an inversion path 21*a*, stopped, conveyed in a reverse direction by a reverse rotation of an inversion roller 21*b*, and then stacked in an intermediate tray 22 with the back surface facing up. Thereafter, the recording material is once again conveyed to a position where it is brought into contact with the photosensitive drum 1 in synchronism with the formation of a toner image.

The recording material carrier sheet 5*f* on the transfer drum 5*a* is contaminated, for example, by particles scattered by the photosensitive drum 1, the developing devices 4*y*, 4*c*, 4*m* and 4*k*, and the cleaning device 6, by toner due to a recording material jam, or by oil attached to the surface of the recording material during double-sided image formation. Accordingly, the recording material carrier sheet 5*f* is cleaned by the cooperative action of a roller 14 composed of a fur brush and a back-up brush 15, and the cooperative action of an oil removal roller 16 and a back-up brush 17. Such cleaning is performed during rotation of the transfer drum 5*a* preceding and following image formation, or whenever a jam occurs.

The image forming apparatus 2001 according to the present embodiment is configured such that, by activating an eccentric cam 25 for the transfer drum 5*a* to activate cam followers 5*i* and 5*j* through two rollers in predetermined timing, a gap between the transfer drum 5*a* and the photosensitive drum 1 can be set to a predetermined interval. For example, when the image forming apparatus 2001 is in a standby mode or when the power is turned off, the transfer drum 5*a* and the photosensitive drum 1 are separated from each other so that the transfer drum 5*a* is rotated independently from rotative driving of the photosensitive drum 1.

In the foregoing series of image formation operations, the developing devices 4*y*, 4*c*, 4*m* and 4*k* operate as follows: When an electrostatic latent image is formed on the photosensitive drum 1 as described above and that electrostatic latent image arrives at a development position corresponding to each of the developing devices 4*y*, 4*c*, 4*m* and 4*k* a development bias composed of an AC bias and a DC bias superimposed one upon the other is applied to development sleeves, not shown, within the respective developing devices, so that the development sleeves are rotated in a predetermined direction and pressurized by development compression cams, not shown, whereby the electrostatic latent image is made visible.

At a video counter 9032 (see FIGS. 14, 15A, 15B, 20A and 20B) inside the controller 1001, described later, the amount of toner to be consumed (hereinafter referred to as "the toner consumption amount") calculated for each pixel based on a video count value of the image data to be transferred to the printer section 1003 is accumulated for each page and the results of the accumulation are sent to the printer engine controller 2200 shown in FIG. 3. The toner consumption amount is calculated using a Look-Up Table (LUT).

The printer engine controller 2200 calculates an amount of toner to be supplied ("toner replenishment amount", in actuality a toner replenishment time period) based on the toner consumption amount indicated by the video counter 9032 and supplies an amount of toner equal to the toner replenishment amount to the developing agent containers inside the developing devices so as to maintain the toner density at a constant level. In the printer engine controller 2200, the information supplied from the controller 1001 may be used as it is, and further, an Automatic Toner Replenisher (ATR) may be used as well in an auxiliary capacity for fine adjustment to change the toner replenishment amount. It should be noted that the video count process described above is performed for each color as described in detail later, and the conversion process for converting from the video count value to the toner replenishment amount as well as the supply process for supplying toner to the developing agent containers are also performed for each color.

Moreover, when combined with control involving sensing changes in image density from the output voltage from a sensor, a predetermined patch latent image for use in developing agent density detection is formed on the photosensitive drum 1 in an area in which no image is formed, the patch latent image is developed into a patch image using the development sleeves described above, and the density of the patch image is read by the patch image density sensor 13. The toner density of the developing agent is controlled so as to keep the density of the patch image (hereinafter referred to as "the patch image density") substantially constant, thus maintaining the quality of images. Such toner density control based on the patch image is performed once every several tens of pages of printing on recording materials.

Figure 3:
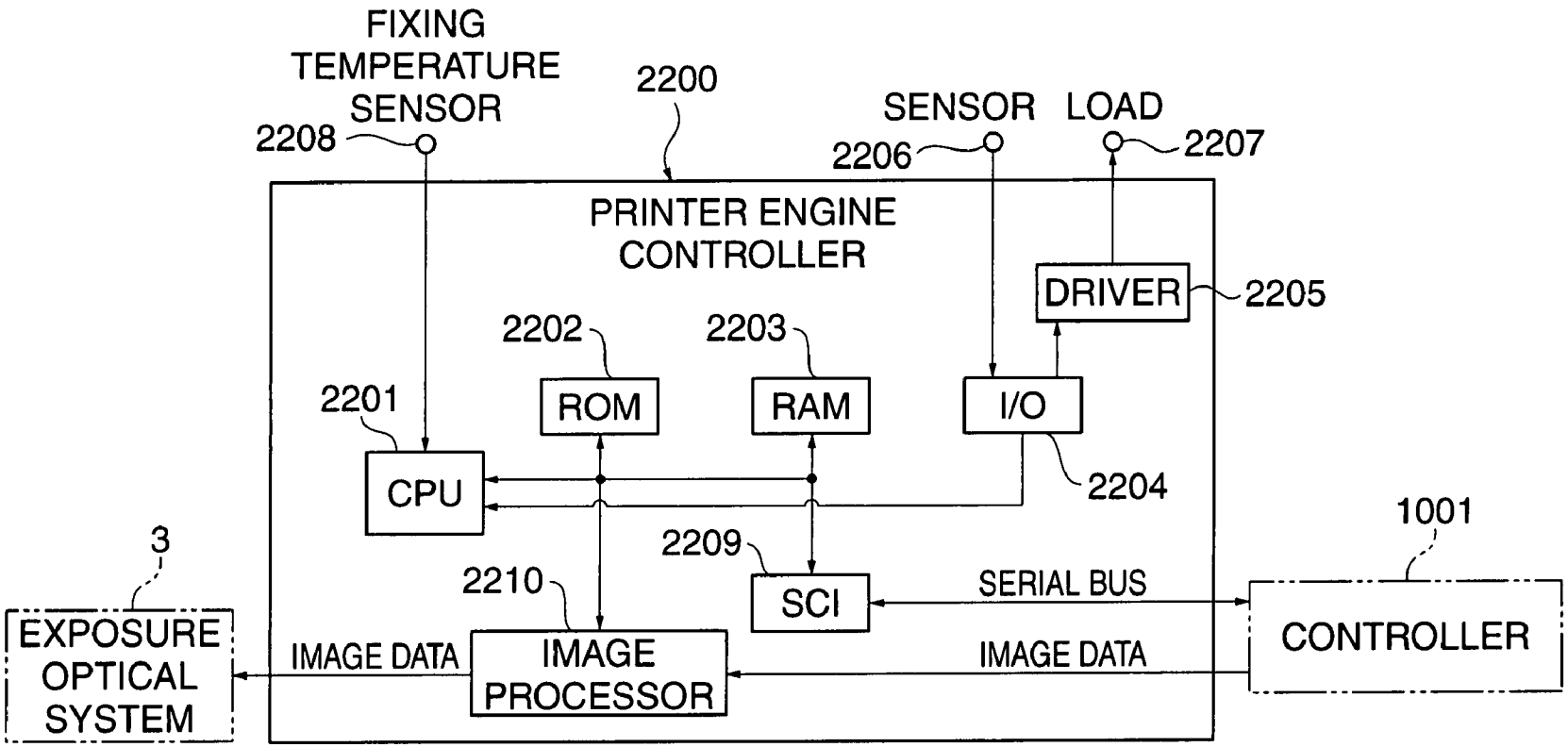
FIG. 3 is a block diagram schematically showing the configuration of a printer controller of a printer appearing in FIG. 2.

FIG. 3 is a block diagram showing the configuration of the printer engine controller 2200 of the printer section 1003 shown in FIG. 2.

As shown in FIG. 3, the printer engine controller 2200 is comprised of a CPU 2201, a ROM 2202, a RAM 2203, an input/output port (I/O) 2204, a driver 2205, a serial communication interface (SCI) 2209, and an image processor 2210.

The CPU 2201 controls the mechanical operation of the printer section 1003 based on a program stored in the ROM 2202 or on a storage medium, not shown. The RAM 2203 is used as a work area when the CPU 2201 executes the program.

The I/O 2204 inputs detection signals from a variety of sensors 2206 provided in the image forming apparatus 2001 via an input port thereof and outputs those signals to the CPU 2201 via an output port thereof. In addition to the patch image density sensor 13 described above, the variety of sensors 2206 may, for example, include a sheet sensor that detects the presence or absence of the recording material (transfer sheet), a discharge sensor, a resist sensor, and a door sensor. Errors are notified to the controller 1001 via the SCI 2209 based on the detection results from this variety of sensors 2206. For example, when a jam occurs, a jam error notice is sent from the printer engine controller 2200 to the controller 1001. A printer malfunction interruption in a step S107 shown in FIG. 16 or FIG. 21, described later, corresponds to such error notification.

Moreover, another output port of the I/O 2204 is connected to the driver 2205, and signals to be output from the I/O 2204 output port to various loads 2207 connected to the image forming apparatus 2001 are converted into required drive voltage by the driver 2205. These various loads 2207 include such devices as fixing heaters for the fixing device 9, agitators for the developing agent inside the developing devices, a toner replenishment screw, the photosensitive drum 1, sheet feed rollers, a motor for driving the fixing device 9 and a clutch and a solenoid.

Figure 4:
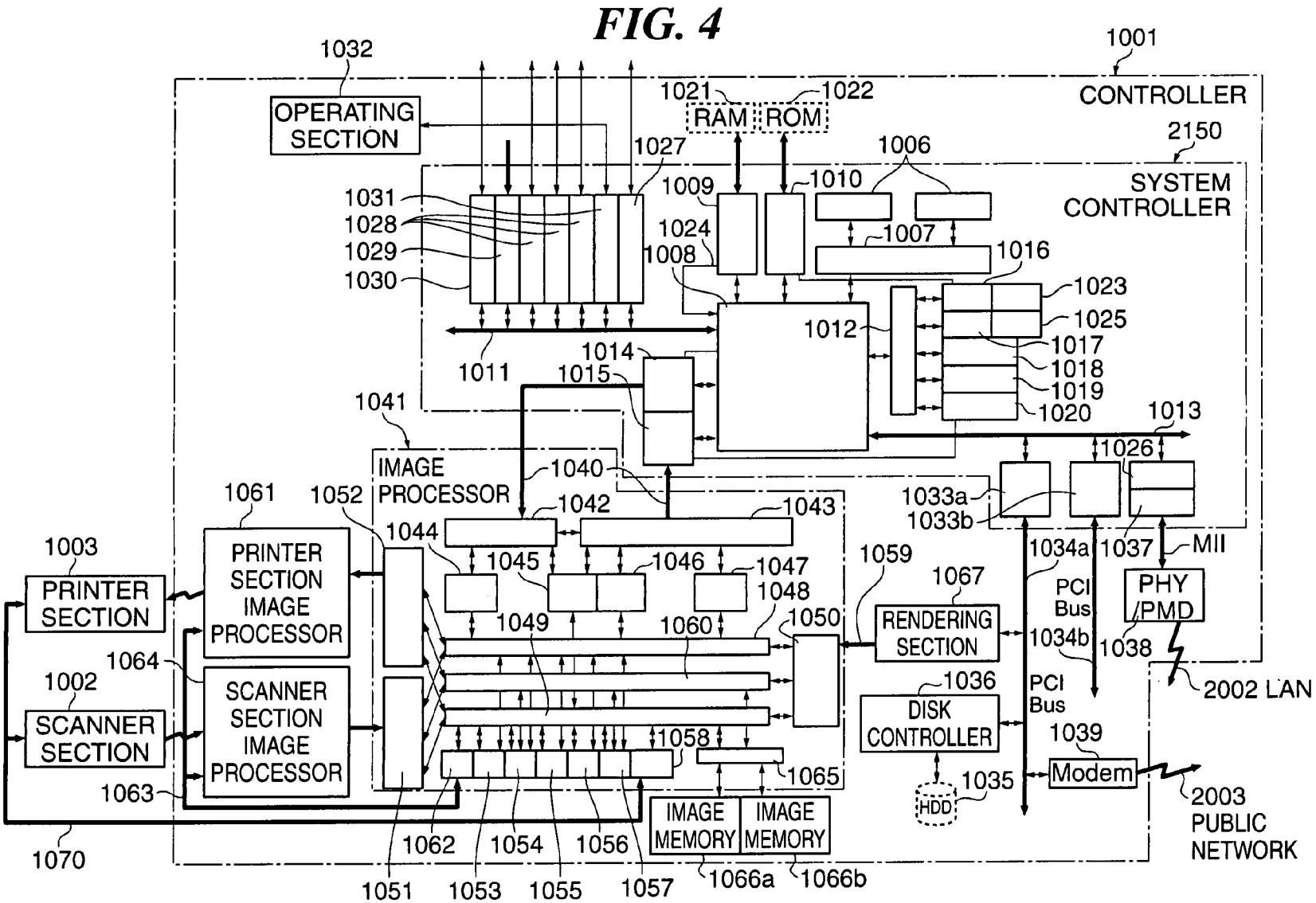
FIG. 4 is a block diagram schematically showing the overall configuration of a controller of the image forming apparatus.

The CPU 2201 exchanges information with the controller 1001 shown in FIG. 4 via the SCI 2209.

A fixing temperature sensor 2208 detects a temperature of the fixing device 9 of the printer section 1003. The fixing temperature sensor 2208 is connected to an A/D input port, not shown, of the CPU 2201. The CPU 2201 controls the fixing heater of the fixing device 9 in response to the temperature detected by the fixing temperature sensor 2208.

The image processor 2210 transmits image data sent from the controller 1001 via a video interface (video bus) to the exposure optical system 3. The video interface may be configured so as to include the SCI 2209, described above, or it may be provided separately.

Figure 5:
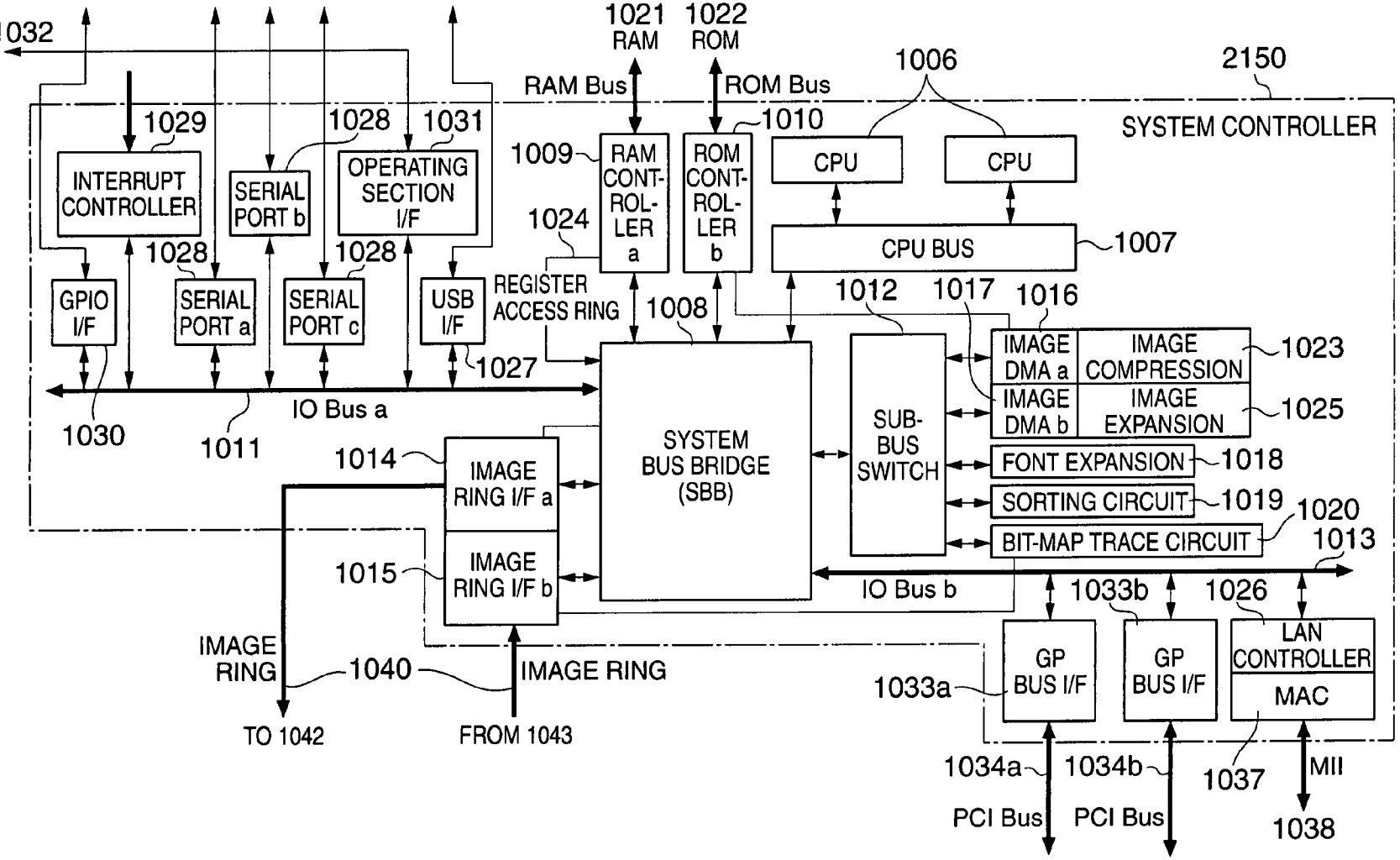
FIG. 5 is a block diagram showing in detail the configuration of a system controller appearing in FIG. 4.

FIG. 4 is a block diagram schematically showing the overall configuration of the controller 1001 of the image forming apparatus 2001 shown in FIG. 2. FIG. 5 is a block diagram showing in detail the configuration of a system controller 2150 shown in FIG. 4. FIG. 6 is a block diagram showing in detail the configuration of an image processor 1041 shown in FIG. 4.

As shown in FIG. 4, the controller 1001 is connected to the scanner section 1002 as the image input device and to the printer section 1003 as the image output device and can be connected to the LAN 2002 and the Internet or intranet 2010, to transmit and receive image information and device information and perform PDL (Page Description Language) data image expansion.

The controller 1001 is comprised mainly of the system controller 2150 and the image processor 1041.

Next, referring to FIG. 5 a detailed description will be given of the configuration of the system controller 2150 inside the controller 1001.

A CPU 1006 is a processor that controls the entire image forming apparatus (system) 2001. In the present embodiment, the CPU 1006 is comprised of two CPUs. These two CPUs 1006 are connected to a system bus bridge 1008 via a joint CPU bus 1007.

The system bus bridge (SBB) 1008 is a first bus switch, to which are connected the CPU bus 1007, a RAM controller a 1009, a ROM controller b 1010, an IO bus a 1011, a sub-bus switch 1012, an IO bus b 1013, an image ring interface (I/F) a 1014 and an image ring interface (I/F) b 1015.

The sub-bus switch 1012 is a second bus switch, to which are connected an image DMA (direct memory access) section a 1016, an image DMA section b 1017, a font expansion section 1018, a sorting circuit 1019 and a bit-map trace circuit 1020. By controlling direct memory access requests (DMA requests) output from the image DMA sections 1016 and 1017, the sub-bus switch 1012 performs processing for connecting to the system bus bridge 1008 in accordance with a DMA request from one of the image DMA sections.

The RAM 1021 shown in FIG. 4 functions not only as a main memory for the operation of the CPU 1006 but also as a work memory and an image memory for temporarily storing image data, and is controlled by the RAM controller a 1009. In the present embodiment, a direct RDRAM (Rambus DRAM) is employed as the RAM 1021. The ROM 1022 shown in FIG. 4 is a boot ROM on which is stored a system boot program, and is controlled by the ROM controller b 1010.

The image DMA section a 1016 is connected to an image compression section 1023, controls the image compression section 1023 based on information set through a register access ring 1024 to thereby read out uncompressed data in the RAM 1021, compress the data, and rewrite the compressed data into the RAM 1021.

The image DMA section b 1017 is connected to an image expansion section 1025, controls the image expansion section 1025 based on information set through the register access ring 1024 to thereby read out compressed data in the RAM 1021, expand the data, and rewrite the expanded into the RAM 1021. It should be noted that, in the present embodiment, the image compression section 1023 and the image expansion section 1025 employ a compression algorithm for JPEG and an expansion algorithm for JPEG, respectively.

The font expansion section 1018 expands compressed font data stored on the ROM 1022 or in the RAM 1021 based on a font code contained in PDL data transferred from an external source via a LAN controller 1026 or the like. In the present embodiment, an FBE algorithm is adopted as the expansion algorithm of the font expansion section 1018.

The sorting circuit 1019 switches the order of display list objects provisionally generated when the PDL data is expanded. The bit-map trace circuit 1020 extracts edge information from the bit-map data.

The IO bus a 1011 is a type of internal IO bus, to which are connected a USB interface 1027, general-purpose serial ports a–c 1028, an interrupt controller 1029, a GPIO (general-purpose IO) interface 1030, and an operating section interface 1031. It should be noted that a bus arbiter, not shown, is included in the IO bus a 1011.

The operating section interface 1031 is an interface section for an operating section 1032, and outputs image data to be displayed at the operating section 1032 to the operating section 1032 as well as transmits information input by the user via the operating section 1032 to the CPU 1006.

The IO bus b 1013 is a type of internal IO bus, to which are connected general-purpose bus interfaces 1033*a*, 1033*b* and the LAN controller 1026. A bus arbiter, not shown, is included in the IO bus b 1013.

The two general-purpose bus interface 1033*a* and 1033*b* are composed of the same bus interfaces, and are bus bridges that support IO bus standard specifications. In the present embodiment, PCI (Peripheral Component Interconnect) buses 1034*a*, 1034*b* are employed as the IO buses.

A hard disk drive HDD 1035 shown in FIG. 4 stores system software, image data, and page information and job information corresponding to the image data. The HDD 1035 is connected to the PCI bus 1034*a* via a disk controller 1036.

The LAN controller 1026 is connected to the LAN 2002 through a MAC circuit 1037 and a PHY/PMD circuit 1038, and inputs and outputs information. A modem 1039 is connected to the public network 2003, and inputs and outputs information.

Next, referring to FIG. 6, a detailed description will be given of the configuration of the image processor 1041 inside the controller 1001.

As shown in FIG. 6, an image ring 1040 is comprised of a pair of unidirectional connection paths. The image ring 1040 is connected to a tile expansion section 1044, a command processor 1045, a status processor 1046, and a tile compression section 1047 via an image ring interface c 1042 and/or an image ring interface d 1043 inside the image processor 1041.

The tile expansion section 1044 is connected to the image ring interface c 1042 and a tile bus 1048. The tile expansion section 1044 expands compressed image data input from the image ring 1040 via the image ring interface c 1042, and transfers the expanded image data to the tile bus 1048. The tile bus 1048 divides a page of image data into several pieces of tile-shaped image data (hereinafter referred to as "the tiles") which are unit blocks of a predetermined size, and processes and transfers the image data in tile units. Thus, a tile is a unit block of a predetermined size.

It should be noted that, in the present embodiment, as compressed image data there is JPEG-compressed multivalic image data and Packbit-compressed binary image data. The tile expansion section 1044 expands such compressed image data.

The tile compression section 1047 is connected to the image ring interface d 1043 and the tile bus 1048. The tile compression section 1047 compresses pre-compression image data input from the tile bus 1048 and transfers the compressed image data to the image ring 1040 via the image ring interface d 1043.

The command processor 1045 is connected to the image ring interface c 1042, the image ring interface d 1043, and a register setting bus 1049. In response to a register setting write request issued by the CPU 1006 and input via the image ring 1040 and the image ring interface c 1042, the command processor 1045 writes information to be set that is included in the register setting write request to a register, not shown, of a corresponding image processing block among a plurality of image processing blocks (modules). Moreover, in response to a register setting read request issued by the CPU 1006, the command processor 1045 reads out information set in a register of a corresponding image processing block via the register setting bus 1049, and transfers the information to the image ring interface d 1043. It should be noted that the image processing blocks described above correspond to a printer section image processor 1061 and a scanner section image processor 1063 shown in FIG. 4, and connected to the register setting bus 1049 and the tile bus 1048, respectively.

The status processor 1046 monitors information from the image processing blocks, and generates an interrupt packet, described later, for issuing an interrupt signal to the CPU 1006, and outputs the interrupt packet to the image ring interface d 1043.

To the tile bus 1048 are connected a rendering section interface 1050, an image input interface 1051, an image output interface 1052, a multivaluing processor 1053, a binarization processor 1054, a color space converter 1055, an image rotator 1056, a resolution converter 1057, a serial bus interface 1058, and an external bus interface 1062. In addition, the tile bus 1048 also includes a bus controller, not shown.

A bit-map image generated by a rendering section 1067, described later, is input to the rendering section interface 1050. The rendering section 1067 and the rendering section interface 1050 are connected via an ordinary video signal line 1059. The rendering section interface 1050 is also connected to a memory bus 1060 and the register setting bus 1049 as well as to the tile bus 1048. The rendering section interface 1050 converts input raster image data into tile-shaped image data according to a specific method previously set through the register setting bus 1049, and outputs the tile-shaped image data to the tile bus 1048.

The image input interface 1051 converts scanned image data from the scanner section 1002 into tile-shaped image data, changes the clock rate of the image data so as to be equal to the clock rate of the image processor 1041, and outputs the tile-shaped image data to the image processor 1041.

The image output interface 1052 converts tile-shaped image data from the tile bus 1048 into raster image data, changes the clock rate of the raster image data so as to be equal to the clock rate of the printer section image processor 1061, and outputs the raster image data to the printer section image processor 1061.

The multivaluing processor 1053 converts binary image data into color or grayscale multivalic image data. The binarization processor 1054 converts multivalic image data into binary image. The color space converter 1055 converts the image data color space of image data for example from YMCK to RGB (red, green, and blue). The image rotator 1056 rotates image data so as to convert the direction of the image data into a predetermined direction. The resolution converter 1057 changes the resolution of image data.

The external bus interface 1062 is a bus bridge that performs predetermined conversion on register read/write requests issued by the CPU 1006 and outputs the converted requests to the external bus 1063 via the image ring interfaces 1014, 1015, 1042, and 1043, the command processor 1045 and the register setting bus 1049. The external bus 1063, in the present embodiment, is connected to the printer section image processor 1061 and a scanner section image processor 1064.

A memory controller 1065 is connected to the memory bus 1060, and, writes and reads image data to and from image memories **1066*a* and 1066*b* according to a previously set address division, as well as refreshes the image memories as required, in accordance with requests from image processors. In the present embodiment, SDRAMs (Synchronous DRAMs) are used as the image memories 1066*a* and 1066*b***.

The serial bus interface 1058 serially communicates with the printer section 1003 and the scanner section 1002 through a serial bus 1070, and acquires from the printer section 1003 and the scanner section 1002 a variety of necessary data such as data on transfer timing of data transfer.

The scanner section image processor 1064 shown in FIG. 4 corrects scanned image data input from the scanner section 1002 as the image input device.

The printer section image processor 1061 performs image correction processing required for outputting images and outputs the results of the correction to the printer section 1003. It should be noted that the printer section image processor 1061 is comprised of the video counter 9032, described later with reference to FIGS. 14, 15A, 15B, 20A and 20B.

The rendering section 1067 renders a PDL code or a provisionally generated display list into a bit-map image.

Next, a detailed description will be given of data formats used in the present embodiment.

In the above-described controller 1001, image data as well as commands (requests) from the CPU 1006 and interrupt information from blocks (modules) such as the functional blocks and the image forming blocks, described above, are transferred in packet format.

Figure 8:
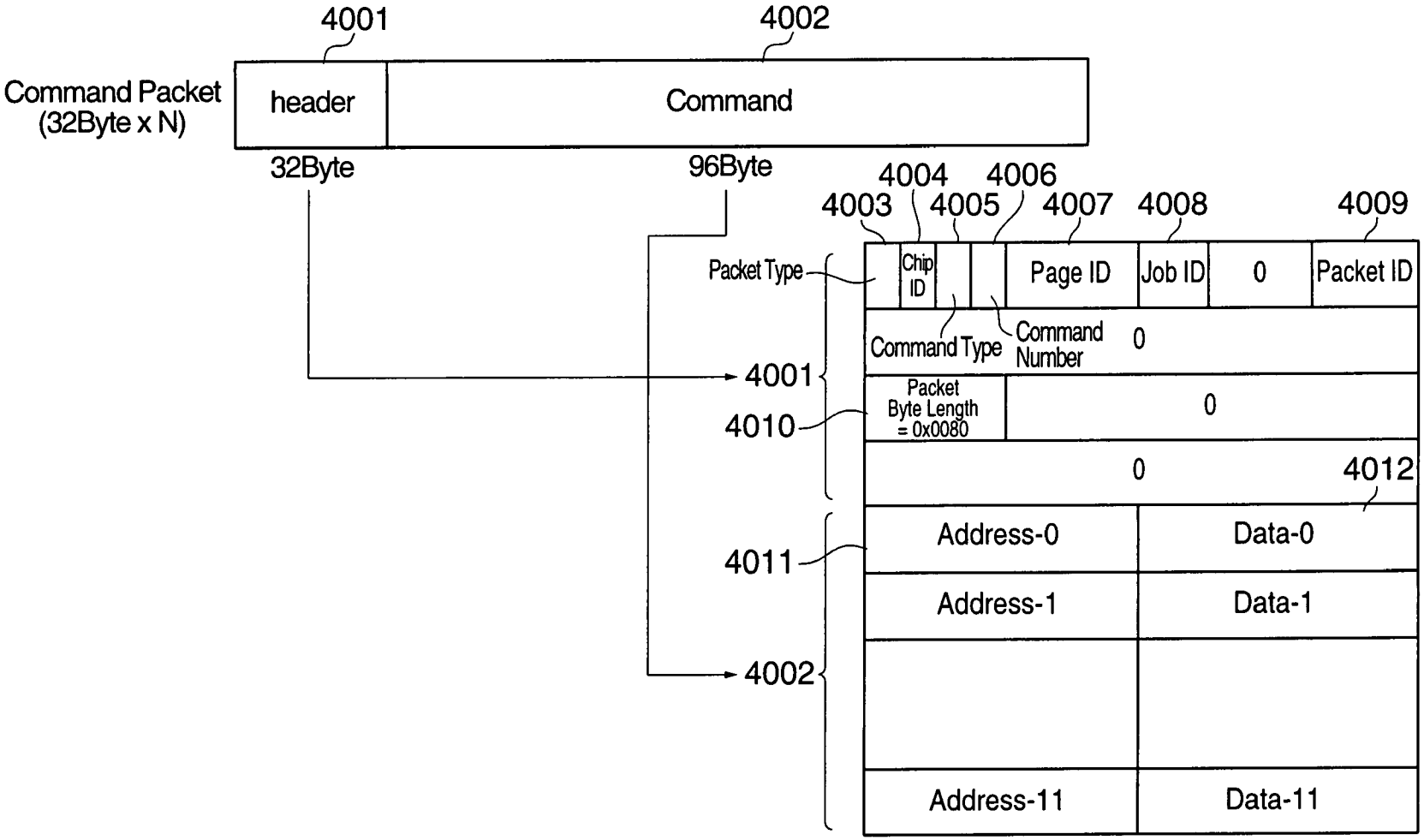
FIG. 8 is a diagram useful in explaining the format of a command packet.
Figure 9:
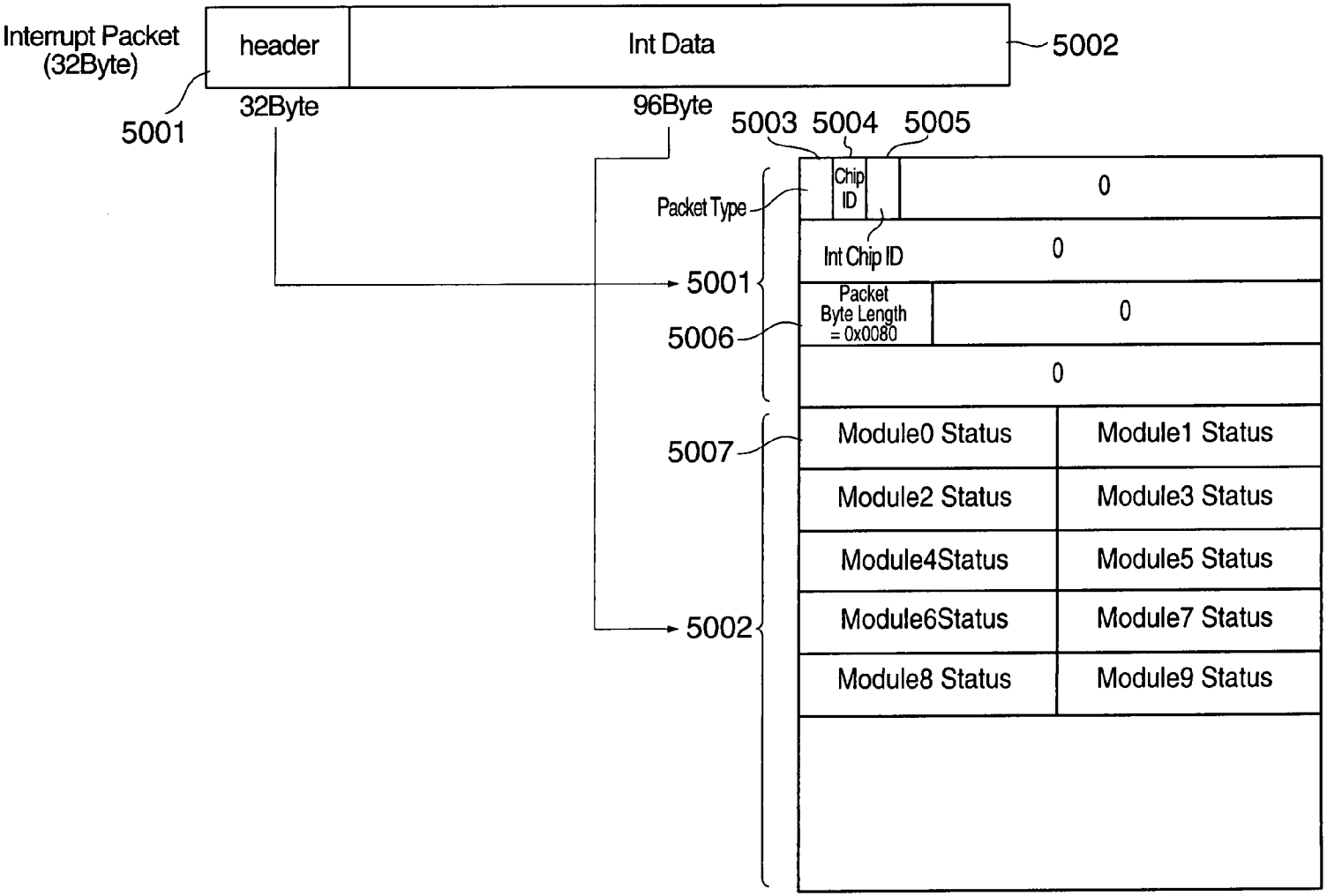
FIG. 9 is a diagram useful in explaining the format of an interrupt packet.

In the present embodiment, three types of packets are used: a data packet for image data shown in FIG. 7, a command packet shown in FIG. 8, and an interrupt packet shown in FIG. 9.

FIG. 7 shows the format of a data packet.

In the present embodiment, image data is divided into pieces of image data 3002 each in a tile unit of consisting of 32 pixels×32 pixels. Necessary header information 3001, image characteristics information 3003, etc. are added to the tile-unit image data 3002 to form a data packet.

A description will now be given of information included in the header 3001 with reference to FIG. 7B.

The packet is identified as a data packet, a command packet, or an interrupt packet, depending on a value of a Packet Type ID 3023 in a Packet Type 3004 in the header 3001. In the present embodiment, the Packet Type ID 3023 is composed of 3 bits, allocated as follows:

| | |
|---|---|
| 001b or 101b: | data packet |
| 010b: | command packet |
| 100b: | interrupt packet |

A Repeat Flag 3022 is included in the Packet Type 3004. If the image data 3002 and the image characteristics information 3003 in the data packet, as well as predetermined information within the header 3001 are the same as those of the immediately preceding transmitted data packet, then the Repeat Flag 3022 is set to "1". When the Repeat Flag 3022 is set to "1", the packet transfer involves only transfer of the header 3001. A chip ID 3005 designates an ID of a chip that identifies a target to which the packet is to be transferred.

A Image Type 3006 designates a type which represents the structure of image data 3002. In the present embodiment, the Image Type 3006 consists of data composed of 8 bits, of which the two highest-order bits specify the type of image data as follows:

"00b" indicates 1 pixel of image data as 1 bit;

"01b" indicates 1 pixel of image data as 8 bits×1 part;

"10b" indicates 1 pixel of image data as 8 bits×3 parts, i.e. a total of 24 bits; and "11b" expresses 1 pixel of image data as 8 bits×4 parts, i.e. a total of 32 bits.

A Page ID 3007 designates the number of a page in which the data packet is included. A Job ID 3008 stores a Job ID for software management purposes.

The order on the page of the data packet is expressed in terms of a combination YnXn of Y-direction tile coordinates (Packet ID Y-coordinate) 3009 and X-direction tile coordinates (Packet ID X-coordinate) 3010.

A process Instruction 3011 designates processing by each block of the image processor 1041 and is comprised of eight sets of an ID for each block of the image processor 1041 and an operating mode. These sets are arranged in order starting from the left end as viewed in FIG. 7. Whenever processing of each block of the image processor 1041 is executed, the sets are shifted to the left by 8 bits. That is, eight sets of Unit ID 3024 and Mode 3025 are stored in the area of the Process Instruction 3011. The Unit ID 3024 indicates one of the blocks of the image processor 1041 and the Mode 3025 indicates an operating mode of the block. Thus, eight blocks can be consecutively processed based on a single packet.

A Packet Byte Length 3012 represents the total number of bytes in the packet, an Image Data Byte Length 3015 represents the number of bytes in the image data 3002, and a Z Data Byte Length 3016 represents the number of bytes in the image characteristics information 3003. An Image Data Offset 3013 and a Z Data Offset 3014 represent the value of offsets of the image data 3002 and the image characteristics information 3003 from the head of the packet.

As the data packet, there are a type in which image data 3002 and the image characteristics information 3003 are compressed and a type in which they are not compressed. In the present embodiment, JPEG compression is used as the compression algorithm in the case where the image data 3002 is multivalic color data or multivalic grayscale data, whereas Packbit compression is used as the compression algorithm in the case where the image data 3002 is binary data. The Packbit compression is also used for image characteristics information 3003.

Whether the image data 3002 and the image characteristics information 3003 are compressed or uncompressed is distinguished from Image Data 3026 and Z Data 3027 of a Compress FLAG 3017, that is, the Image Data 3026 and Z Data 3027, when set to "1", indicate that the data are compressed, and when set to "0", indicate that the data are uncompressed.

The Compress Flag 3017 includes a Q-Table ID 3028 containing a value corresponding to the type of a quantization table that was used when compressing data using JPEG compression. Where there is a plurality of quantization tables, the quantization table to be used is switched with reference to the value of the Q-Table ID 3028 when compressing and expanding data.

A Source ID 3018 identifies the source from which the image data 3002 and image characteristics information 3003 were generated. A Z Type 3020 indicates the effective bit length of the image characteristics information 3003, such that image characteristics information 3003 having a value different from the value indicated by the Z Type 3020 is invalid information. It should be noted that when the value of the Z Type 3020 is "0", the input image characteristics information 3003 is invalid.

A Z dummy 3033 has set therein a substitute value for the image characteristics information 3003 when a flag of a Compress Fail 3032, referred to later, is set.

Thumbnail Data 3021 contains values (hereinafter referred to as "the thumbnail values") representing the image data 3002 of the data packet. In the present embodiment, a maximum of four thumbnail values can be stored in the Thumbnail Data 3021.

A Misc 3019 can store required information other than the information described above, as a Char-flag 3030, a Q-Table Sel 3031, and the Compress Fail 3032.

Information indicative of an area to which the data packet belongs is stored in the Char-flag 3030. Information for changing the quantization table used during compression and expansion using the JPEG method is stored in the Q-Table Sel 3031. The Char-flag 3030 and the Q-Table Sel 3031 both count the number of pixels having predetermined image characteristics indicated by the image characteristics information 3003 in the data packet and the flags are turned on/off depending on the results of that count.

The Compress Fail 3032 is a flag set where the size of the data after compression exceeds a predetermined value.

FIG. 8 shows the format of the command packet.

The command packet is used for accessing the register setting bus 1049. The command packet is also used to enable the CPU 1006 to access to the image memories 1066*a* and

1066*b*. The command packet is composed of header information (header) 4001 and packet data (Command) 4002.

The header 4001 includes a chip ID 4004 containing an ID that identifies the image processor 1041 as the transmission destination of the command packet. A Page ID 4007 and a Job ID 4008 store a Page ID and a Job ID, respectively, for software management purposes.

A packet ID 4009 is expressed in a single dimension, using only the data packet X-coordinate (that is, the tile coordinates in the X direction) 3010. A Packet Byte Length 4010 is fixed at 128 bytes.

A maximum of 12 commands, each comprised of an address 4011 and data 4012, can be stored in the packet data 4002. The type of command, whether write or read, is indicated by a Command Type 4005. The number of commands is indicated by a Command Number 4006.

FIG. 9 shows the format of the interrupt packet.

The interrupt packet sends notification of an interrupt from the image processor 1041 to the CPU 1006. The status processor 1046 is inhibited from transmitting another interrupt packet after an interrupt packet is transmitted and until permission for the next transmission is permitted.

The interrupt packet is comprised of header information (header) 5001 and packet data (Int data) 5002. A Packet Byte Length 5006 within the header 5001 is fixed at 128 bytes. Status information 5007 for the blocks (modules) of the image processor 1041 is stored in the packet data 5002. Thus, the status processor 1046, by using the interrupt packet, can collect status information on the modules of the image processor 1041 and send them all at once to the system controller 2150.

A Chip ID 5004 contains an ID that identifies the system controller 2150 as the transmission destination of the interrupt packet. An Int Chip 5005 contains an ID that identifies the image processor 1041 as the transmission source of the interrupt packet.

Data packets, described above, when stored in a memory, are managed in a form called a Packet Table.

Figure 10:
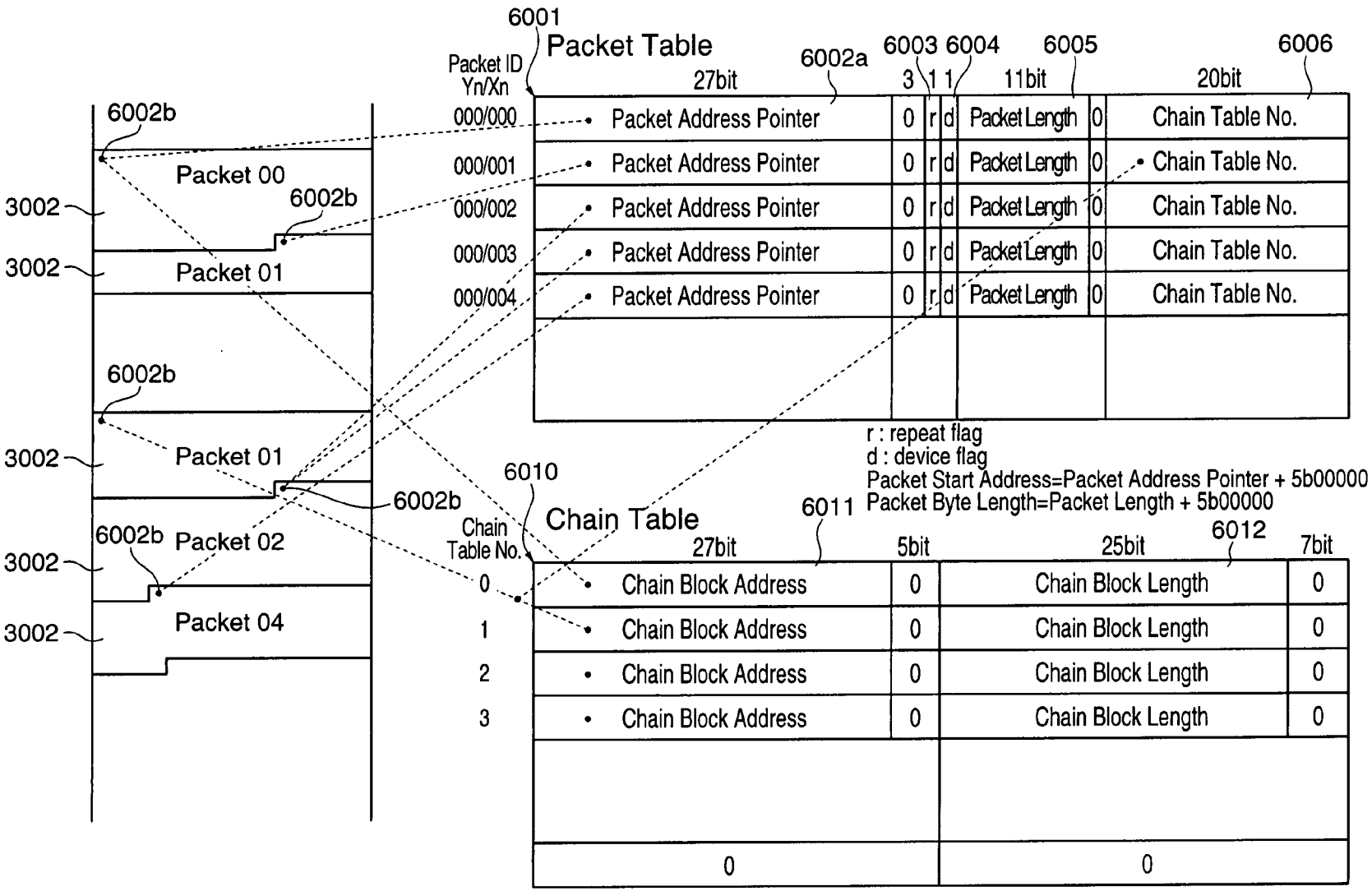
FIG. 10 is a diagram showing the structure of a packet table showing the arrangement of a plurality of data packets as shown in FIG. 7.

FIG. 10 is a diagram showing the structure of a Packet Table, showing the arrangement of a plurality of data packets stored in the RAM 1021.

As shown in FIG. 10, a Packet Table 6001 is comprised mainly of 27-bit Packet Address pointers 6002*a* storing values for identifying start addresses 6002*b* of a plurality of data packets 3002 (on the left in FIG. 10) and 11-bit Packet Lengths 6005 that each store a value for identifying the number of bytes of the data packet 3002 identified by the corresponding Packet Address Pointer 6002*a*.

In the Packet Table 6001, 5 bits of "0" (5b 00000) are added to the value of the Packet Address Pointer 6002*a* to provide a start address 6002*b* of the data packet 3002. In other words, Packet Address Pointer (27 bit)+5b 00000=Packet Start Address.

5 bits of "0" (5b 00000) are added to the value of the Packet Length 6005 to provide a Packet Byte Length indicating the number of bytes of the data packet 3002. In other words, Packet Length (11 bit)+5b 00000=Packet Byte Length.

The data packets 3002 and their component values are arranged in the scanning direction, that is, the Packet IDs of the data packets 3002 are arranged in the order of Yn/Xn (Y-direction tile coordinates/X-direction tile coordinates) =000/000, 000/001, 000/002 . . . . The Packet IDs registered in the Packet Table 6001 each indicate a unique data packet 3002 including a single piece of tile image data. The next registration after Yn/Xmax is Yn+1/X0.

When a data packet 3002 with the above-mentioned Repeat Flag 3022 in the header 3001 set therein is registered in the Packet Table 6001, the same values of Packet Address Pointer 6002*a* and Packet Length 6005 of that data packet 3002 as the immediately preceding data packet 3002 already registered are written to the Packet Table 6001 without being written to the RAM 1021. That is, on this occasion, a plurality of pairs of values of Packet Address Pointer 6002*a* and Packet Length 6005 in the Packet Table 6001 describe a single data packet 3002 in the RAM 1021. In this case, the Repeat Flag 6003 is set for the immediately following and subsequent data packets 3002 in the Packet Table 6001.

The data packets 3002 may also be stored in a dispersed fashion in the RAM 1021. In this case, the data packets 3002 are managed using a Chain Table 6010 (shown at the bottom of FIG. 10) correlated with the packet Table 6001. The Packet Table 6001 also permits a single data packet 3002 to be divided and managed.

Where a single data packet 3002 is thus divided into a plurality of data packets 3002 and managed, a Divide Flag 6004 is set and a Chain Table number 6006 of a Chain Block containing the start portion of the data packet 3002 that is divided is set. It should be noted that the Packet table 6001 and the Chain Table 6010 are not divided.

What is registered in the Chain Table 6010 are Chain Table numbers that are the same as the Chain Table numbers 6006 set in the Packet Table 6001, Chain Block Addresses 6011 and Chain Block Lengths 6012, and at the end of these registered items is stored "0".

Next, a detailed description will be given of the scanner image processor 1064.

Figure 11:
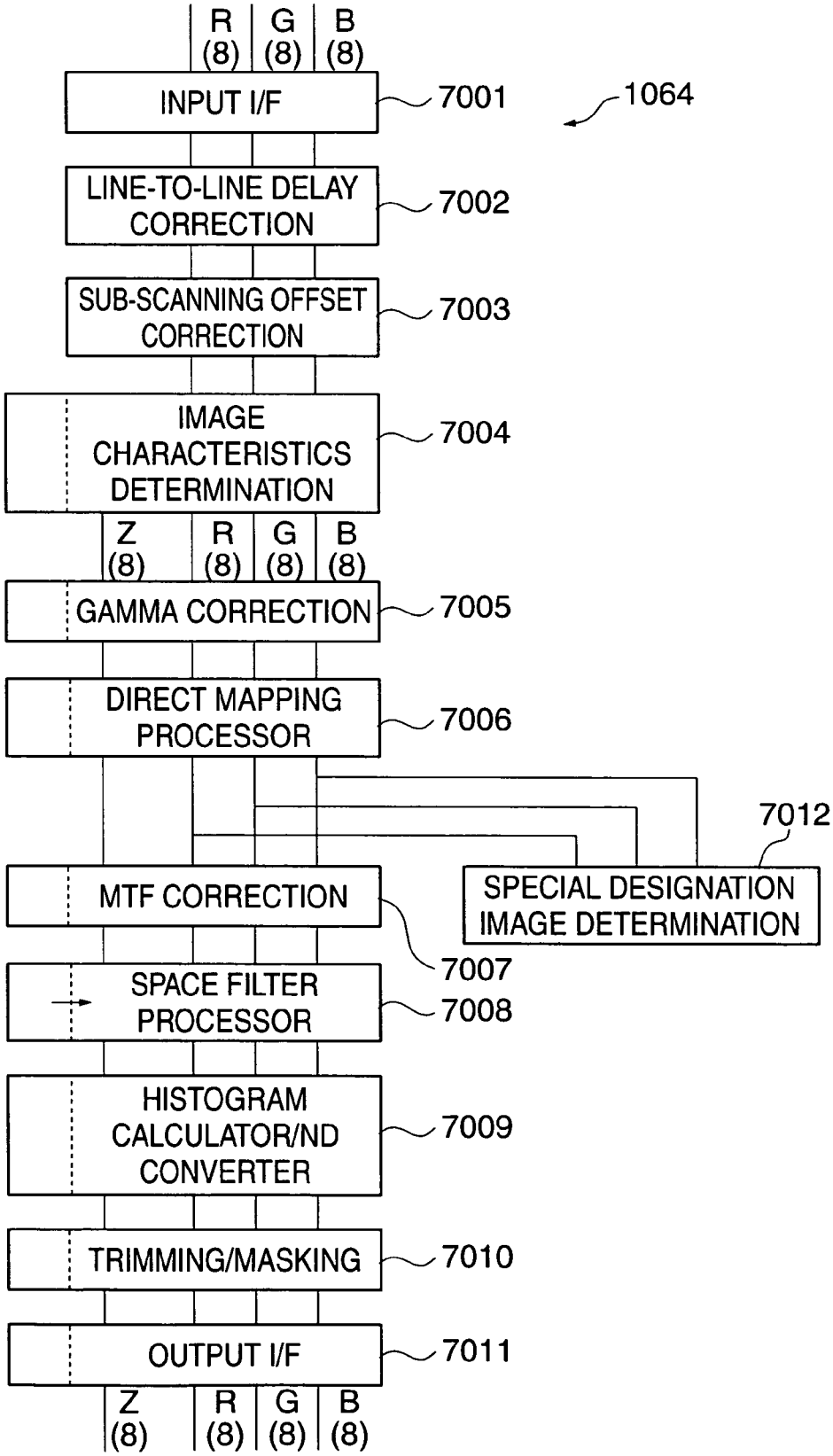
FIG. 11 is a block diagram showing the internal configuration of an image processor for the scanner appearing in FIG. 4.

FIG. 11 is a block diagram showing the internal configuration of the scanner section image processor shown in FIG. 4.

Image data of the colors R, G, and B input from the scanner section 1002 are frequency modulated by an input I/F 7001 so as to be synchronized with a clock of the scanner section image processor 1064 and are output to a line-to-line delay corrector 7002. Where the scanner section 1002 has an image scanning device comprised of a three line sensor, line-to-line delays exist between the R, G, and B colors, which color line-to-line delays are corrected by the line-to-line delay corrector 7002. A sub-scanning offset correcting section 7003 corrects an offset in the sub-scanning direction due to chromatic aberration of the optical system of the scanner section 1002, etc.

An image characteristics determining section 7004 performs edge detection of the image data based on the type of an original and also determines characteristics, such as the presence or absence of characters and colors in the image data, and outputs R, G, and B image data together with the characteristics information (Z). A gamma corrector 7005 and a direct mapping processor 7006 correct and output the image data according to the characteristics of the scanner section 1002. For example, the gamma corrector 7005 corrects the dynamic range for each color, and the direct mapping processor 7006 corrects the tone of the R, G, and B, image data from the scanner section 1002.

Image data output from the direct mapping processor 7006 is input to an MTF (Modulation Transfer Function) corrector 7007 and a specified image determining section 7012. The MTF corrector 7007 performs corrections according to the aperture and color aberration of the optical system in the main scanning direction. The specified image determining section 7012 determines by pattern matching or the like whether or not the input image data is the same as image data that are legally inhibited from being printed out, such valuable securities.

A space filter processor 7008 performs space filtering such as edge emphasis and smoothing on the image data input from the MTF corrector 7007. The space filtering is performed as appropriate in response to the results of the determination performed by the image characteristics determining section 7004 described above. For example, where the input image data is determined to be character data, an edge emphasis process is performed. Where the input image data is determined to be image data of a photograph or other continuous tone, a smoothing process is performed.

A histogram calculator/ND converter 7009 obtains histograms of input image data as well as converts chromatic R, G, and B input image data into monochrome image data using an ND (neutral density) filter. A trimming/masking section 7010 performs processing of an image area to be printed out, such as frame erasure and binding frame erasure. An output I/F 7011 changes a clock frequency of the image data and characteristics information thereof so as to be in synchronism with the clock frequency of the image processor 1041 and the system controller 2150 based on the clock frequency of the scanner image processor 1064, and outputs the image data etc. to the image input interface 1051.

Figure 12:
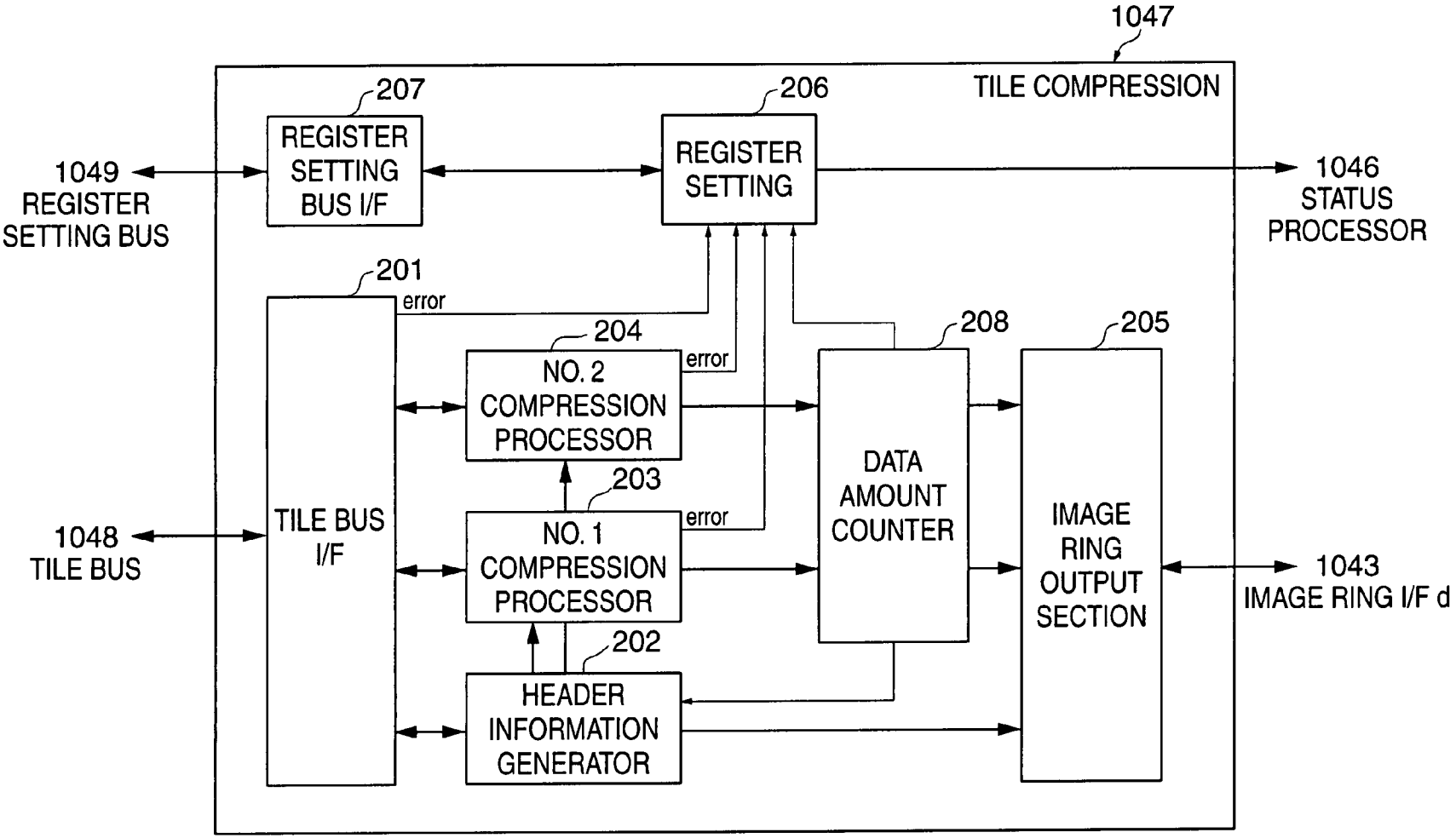
FIG. 12 is a block diagram showing the internal configuration of a tile compression section appearing in FIG. 6.

FIG. 12 is a block diagram showing the internal configuration of the tile compression section 1047 shown in FIG. 6.

As shown FIG. 12, a tile bus interface 201 handshakes or performs data communication with the tile bus 1048 to acquire image characteristics information, image data, and header information of data packets input from the tile bus 1048, and outputs the same to downstream blocks.

Moreover, the tile bus interface 201 analyzes the acquired header information. Where the header information contains a contradiction, the tile bus interface 201 outputs an interrupt signal to a register setting section 206, described later. After outputting the interrupt signal, the tile bus interface 201 ceases operating until input of a reset signal, not shown.

Figure 13A:
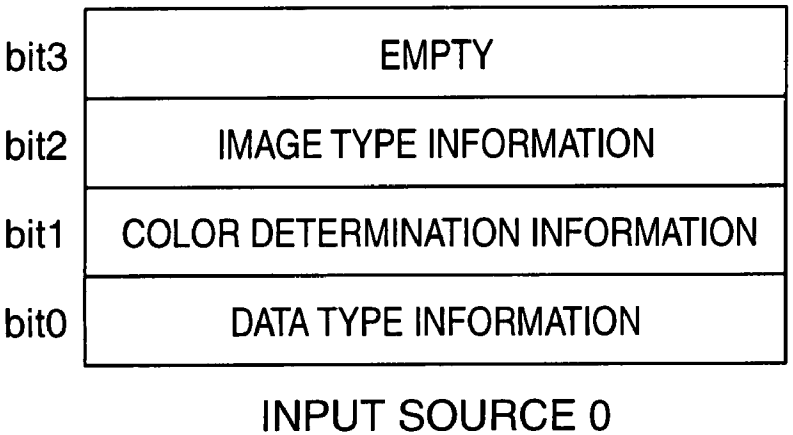
FIGS. 13A and 13B are diagrams showing examples of the structure of image characteristics information included in the data packet shown in FIG. 7.
Figure 13B:
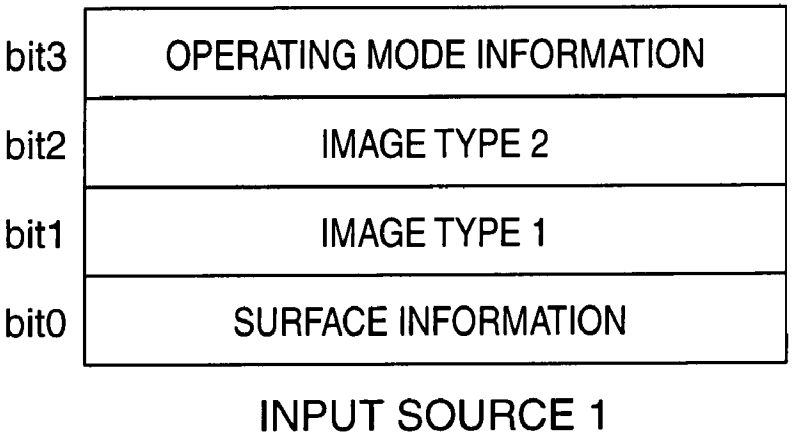

FIGS. 13A and 13B are diagrams showing the structure of examples of image characteristics information included in data packets that are supplied to the printer section image processor 1061.

In the present embodiment, image characteristics information included in a data packet is composed of 4 bits of which contents are different depending on the type of the supply source (hereinafter referred to as "the input source"). In FIG. 13A, image characteristics information included in PDL data or the like transferred via the LAN 2002 is represented as a type 0 (input source 0), whereas in FIG. 13B, image characteristic information included in scanned image data read by the scanner section 1002 is represented by a type 1 (input source 1).

In the case of the image characteristics information of the input source 0 shown in FIG. 13A, bit 0 indicates data type information for identifying whether the image data is raster image data or font data, bit 1 indicates color determination information for determining whether the image data is grayscale data or color data, bit 2 indicates image type information for identifying whether or not the image data is character data, and bit 3 is an empty bit.

In the case of the image characteristics information of the input source 1 shown in FIG. 13B, bit 0 indicates surface information for identifying two pages prior to combining, where the two pages are combined and printed onto one sheet of paper. By thus including area information relating to the layout in the image characteristics information, the image processing can be set independently for each page even where a plurality of pages are printed onto a single sheet and a plurality of such printed sheets are bound.

Bit 1 of the input source 1 image characteristics information indicates an image type 1 for identifying whether the image data is continuous tone data such as a photograph or image data formed by area coverage modulation as typified by a screen and a dither matrix, and bit 2 indicates an image type 2 for identifying whether or not pixels of the image data are character area data. Moreover, bit 3 indicates information for identifying an operating mode of the printer engine (the printer section 1003).

The image data input source types are stored on the HDD 1035 shown in FIG. 4. One of the types is read out by the CPU 1006 at the start of printing, and the mage processor 1041 performs image processing in response to the read out input source type.

Next, a detailed description will be given of the printer section image processor 1061.

Figure 14:
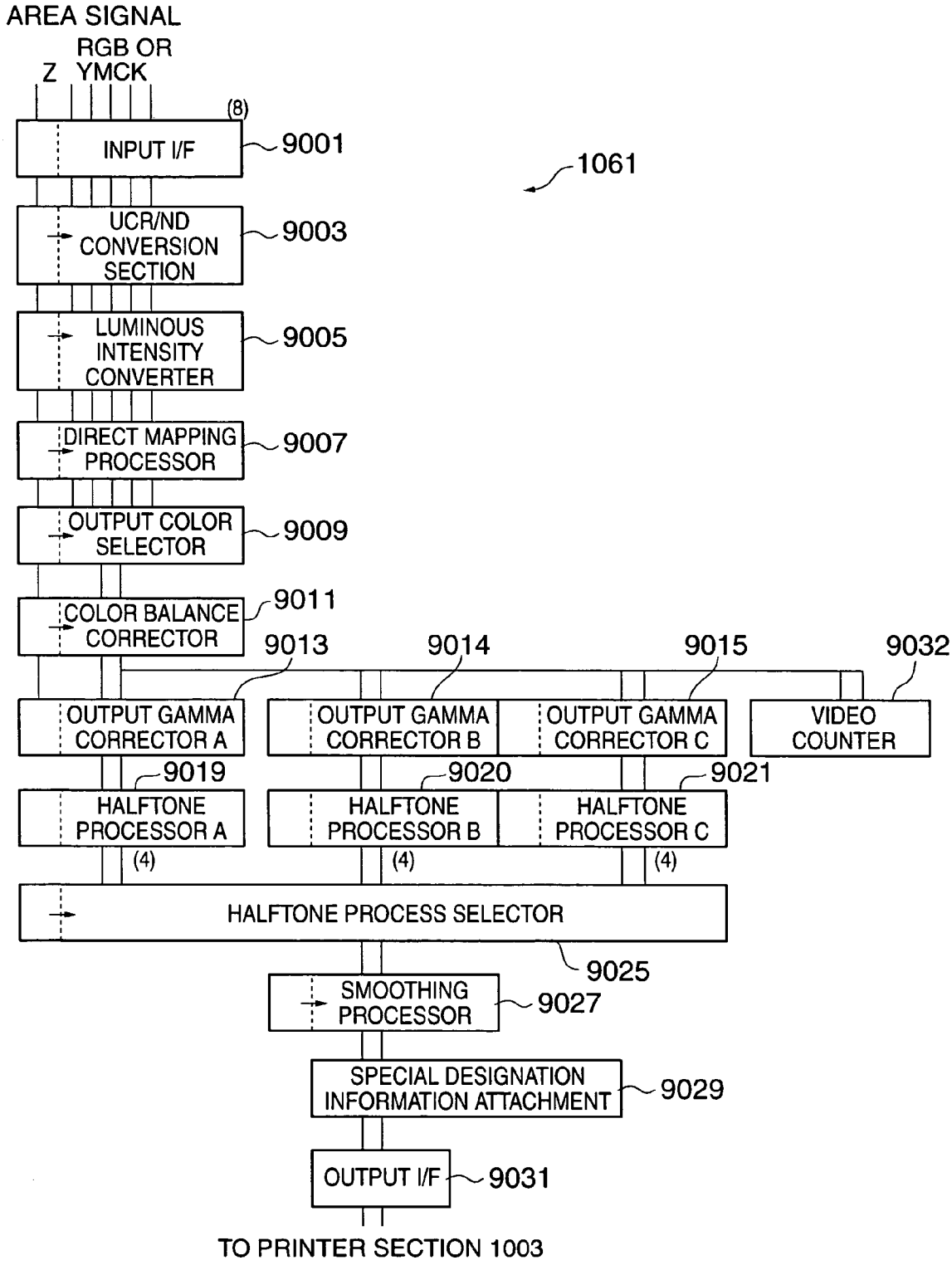
FIG. 14 is a block diagram showing the configuration of an image processor for a printer appearing in FIG. 4.

FIG. 14 is a block diagram showing the configuration of the printer section image processor 1061 shown in FIG. 4. It should be noted that, to speed up register setting between colors for printing, the printer section image processor 1061 is comprised of two processing blocks of an identical configuration. FIG. 14 shows one of the two processing blocks. The two processing blocks generate data of two colors adapted to the printer engine.

An input I/F 9001 converts the clock frequency of a data packet including image data input from the system (image processor 1041) into the clock frequency of the printer section image processor 1061 and outputs the data packet to an under color removal (UCR)/ND conversion section 9003. Depending on the image characteristics information (Z) in the data packet, the UCR/ND conversion section 9003 removes an under color that is the background color of the input image data and converts the same to a predetermined color, or converts RGB color data into monochrome image data using an ND filter.

A luminance-to-density converter 9005 performs luminance-to-density conversion on the input image data according to the image characteristics information. A direct mapping processor 9007 converts the RGB input data into C/M/Y/K color components which are used by the printer engine according to the image characteristics information. An output color selector 9009 selects colors of image data to be output to the printer section 1003.

A color balance corrector 9011 performs fine adjustment of the tone of the output image in accordance with the image characteristics information. An output gamma corrector A 9013, an output gamma corrector B 9014, and an output gamma corrector C 9015 correct the dynamic range and tone curve of the output image. In the present embodiment, the output gamma correctors 9013 to 9015 perform three types of gamma corrections A to C on the output image data for the respective colors simultaneously, with the results being output to a halftone processor A 9019, a halftone processor B 9020, and a halftone processor C 9021, respectively.

The halftone processors 9019 to 9021 perform halftone processing that quantizes the image data and changes the gradation of the output image. In the present embodiment, 8-bit image data input to the printer section image processor 1061 is converted into 4-bit image data. As the halftone processing method, in general a screen process and an error diffusion process are well known, and in the present embodiment, the image data of the respective colors are subjected to the three types of halftone processing A to C.

The image data subjected to the gradation conversion by the halftone processing is transferred by DMA transfer, as described later. As a result, not only can the number of signal lines required by the video interface be reduced and the process of transferring image data from the controller 1001 to the printer engine controller 2200 by the DMA transfer be streamlined and its reliability improved, but also the construction of the interface section (video interface) between the controller 1001 and the printer engine controller 2200 can be simplified and their cost reduced.

A halftone process selector 9025 selects from among the image data processed by the halftone processors 9019 to 9021 one optimum image data depending on the image characteristics information. A smoothing processor 9027 performs a pattern matching process that reduces "ununiformity" of character edges and the like according to the image characteristics information. A specific information adding section 9029 adds image information that can specify the printer section 1003 to the output image data. An output I/F 9031 changes the frequency of the data packets to output the image data in synchronism with the clock of the printer section 1003.

The video counter 9032 calculates an amount of toner to be consumed for each pixel from data values of the pixels of the input image data, accumulates the calculated toner amounts to thereby calculate the amount of toner to be used by all the pixels of the image data for a single page.

Ideally, an amount of the consumable material, i.e. the developing agent required to form an image corresponding to 1 dot of image data is constant. However, in actuality the amount of the consumable material required to form an image corresponding to 1 dot varies due to such factors as the environmental conditions under which the image forming apparatus 2001 is operated. To obtain a desired density of the output image to be reproduced, the color balance corrector 9011 is provided with an adjustment capability that gamma-corrects the image data depending on such environmental conditions as temperature and wear using a gamma table. However, the amount of the consumable material that is actually consumed depends on the density desired to be reproduced. In other words, an amount of the consumable material that is actually consumed by printing the image data after the gamma correction corresponds to an ideal amount (under the standard environment) of consumable material to be consumed for the image data prior to the gamma correction. With regard to this point, as shown in FIG. 14 the video counter 9032 is disposed between the color balance corrector 9011 and the output gamma correctors 9013 to 9015, and thus the video count process is performed not on the image data after the gamma correction for the purpose of reproducing the density in accordance with environmental conditions but also on the image data before the gamma correction. As a result, the amount of the toner (consumable material) in the developing agent to be consumed can be predictively calculated with greater accuracy. It should be noted that the video counter 9032 is connected to the halftone processors 9019 to 9021.

Figure 15A:
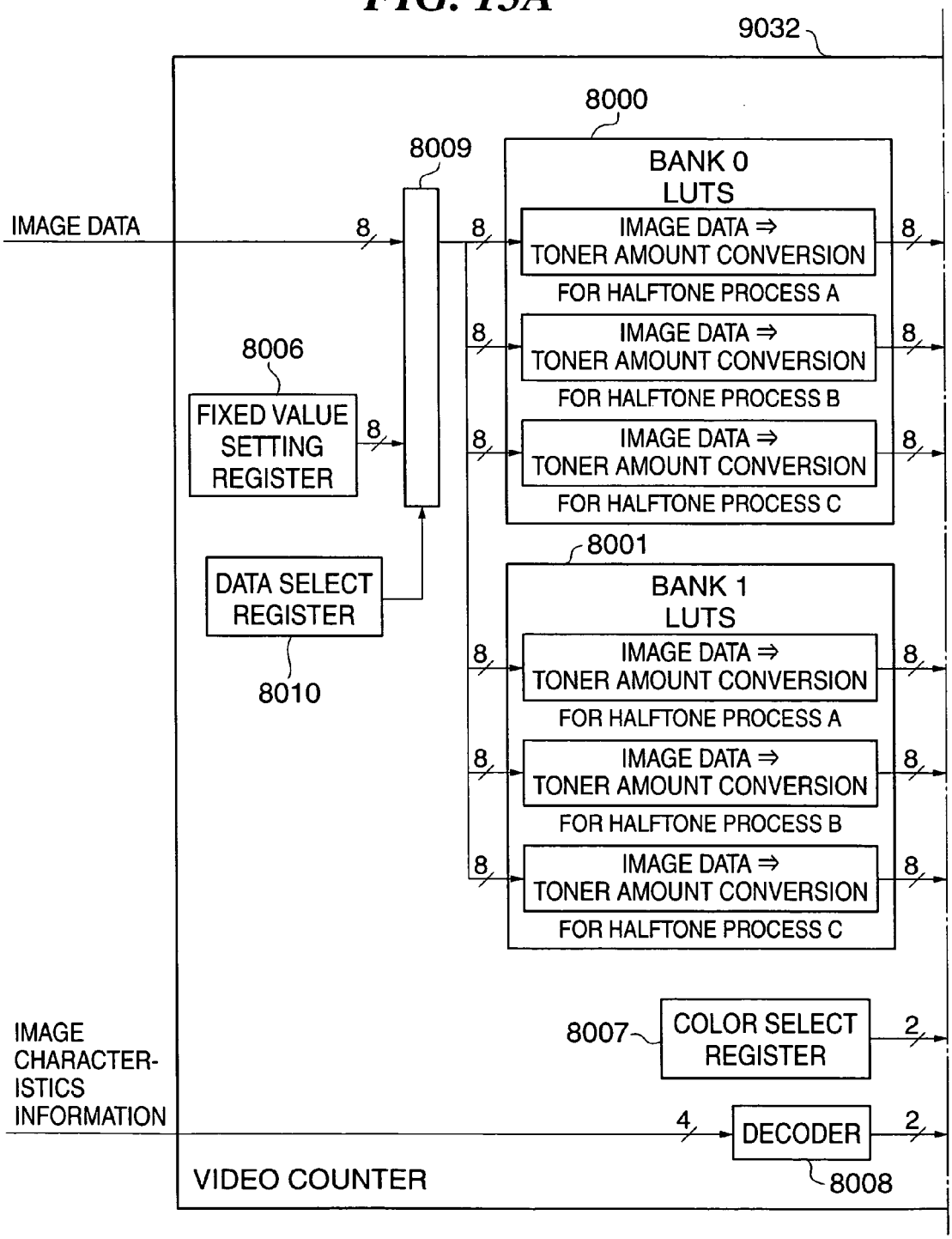
FIGS. 15A and 15B are block diagram showing the internal structure of a video counter appearing in FIG. 14.
Figure 15B:
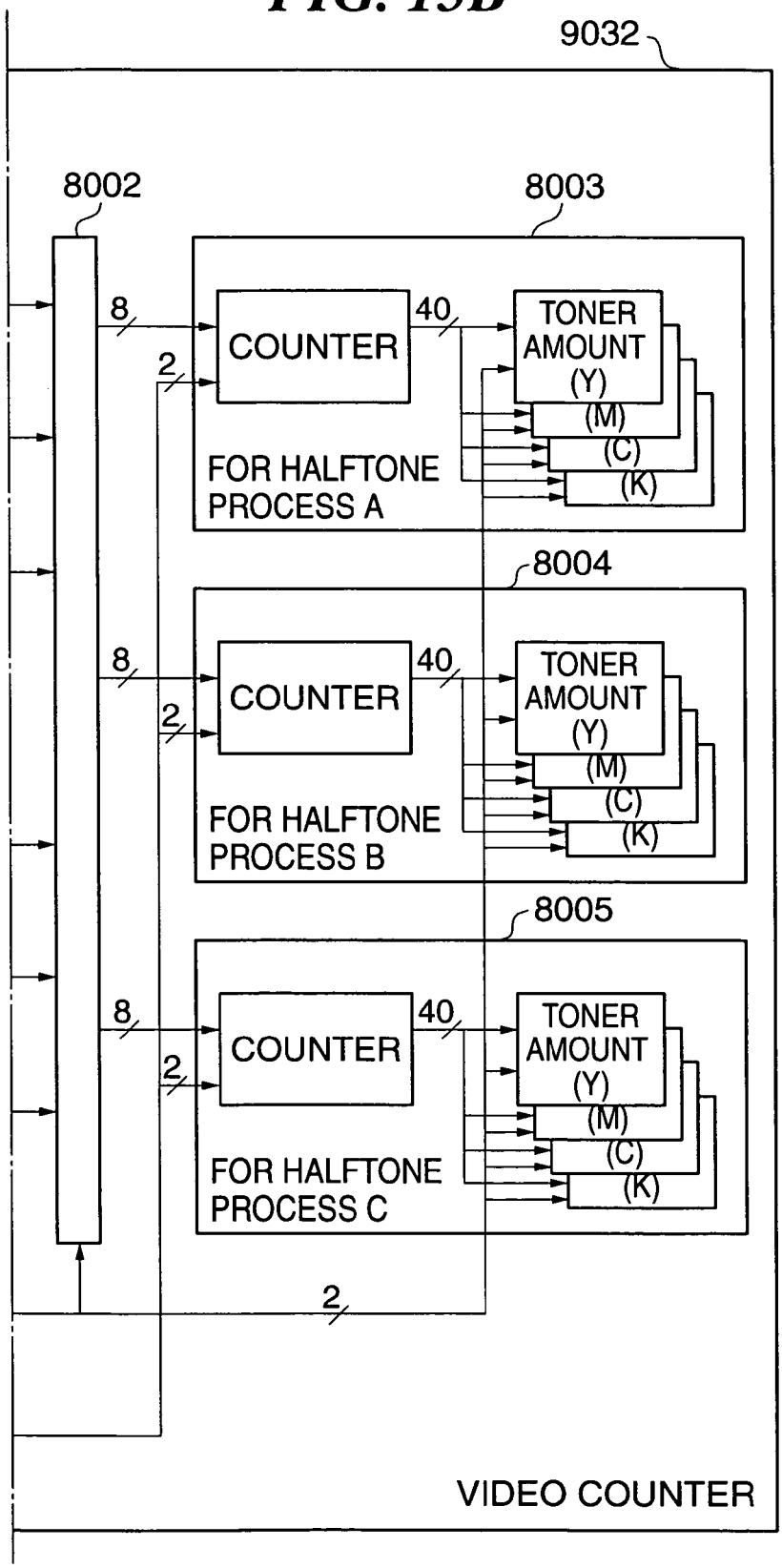

FIGS. 15A and 15B are block diagram showing the internal structure of the video counter 9032 shown in FIG. 14.

In FIGS. 15A and 15B, the video counter 9032 acquires, through accumulation and counting, a toner consumption amount per page required to print a single page by the image forming apparatus 2001 as a color MFP, and also acquires an accumulated toner amount for each of the four colors YMCK of the image data required for printing after executing the three types of halftone processing A to C on the respective colors, and stores the acquired toner amount per page and the acquired accumulated toner amounts for the respective colors in registers of corresponding toner amount accumulative counters 8003, 8004, and 8005, described later.

Image data-toner amount converters 8000 and 8001 (banks 0 and 1) calculate the amount of toner to be consumed according to the density value of the input image data. To calculate the amount of toner, three previously prepared conversion tables corresponding to the three types of halftone processing A to C by the halftone processors 9019 to 9021 are set in each of the image data-toner amount converters 8000 and 8001 as LUTs. This is because, although the amount of the consumable material to be consumed depends on the density value of the image data, the relationship between the density value of the image data and the amount of the consumable material to be consumed changes according to the contents of the halftone processing types A to C additionally executed when converting the input image data into quantized image data.

Specifically, in a halftone process involving error diffusion used for the PDL data font, for example, dots within a unit surface area of the image data are dispersed, whereas, by contrast, in a halftone process involving a screen used for a character area in scanned image data, for example, dots are concentrated in a certain direction depending on the screen pattern. In the case where the dots are concentrated, due to overlapping of the dots the density to be reproduced is low for the number of dots to be printed. Thus, for example, even with image data of the same density value, it is not always the case that the consumption amount of the consumable material is the same as the case where the dots are dispersed. In other words, if the halftone processing changes, the toner consumption amount after halftone processing also changes.

In the present embodiment, as described above, a plurality of LUTs are provided corresponding to the plurality of types of halftone processing A to C, and therefore the amount of the consumable materials to be consumed, which can vary according to the type of the halftone processing performed, can be predicted accurately. It should be noted that the types of halftone processing are switched using a font identification signal for PDL data, a character area determining signal in the scanned image data, and the like, which are included in the image characteristics information, as will be described with respect to a step S1703 in FIG. 17, described later.

Moreover, as also shown in FIG. 14, the three LUTs corresponding to the three halftone processing types A, B and C are intended for processing on the image data before the gamma correction, and therefore, as described above, the amount of the consumable material to be consumed can be predicted more accurately than the case where the LUTs are intended for processing on the image data after the gamma correction which compensates for changes over time due to environmental conditions. Moreover, because the above-described LUTs are intended for processing on the image data prior to image processing (that is, halftone processing), the amount of the consumable material to be consumed can also be calculated more accurately than the case where the LUTs are intended for processing on the image data after halftone processing affected by the gamma correction.

A fixed value setting register 8006 stores a predetermined fixed value for setting the video count value to a predetermined fixed value when processing ends due to a malfunction. A selector 8002 switches between input of image data from the image processor 1041 and input of the fixed value from the fixed value setting register 8006. A data select register 8010 outputs a select signal for switching an output of the selector 8009. A color select register 8007 is used for image data color selection.

The selector 8002 selects an output from one of the two image data-toner amount converters 8000 and 8001 and inputs the selected output to the toner amount accumulative counters 8003, 8004, and 8005. A bit 0 signal input from the color select register 8007 is used as the select signal.

The toner amount accumulative counters 8003, 8004, and 8005, which correspond to the three halftone processing types A to C, are each comprised of counters for sequentially accumulatively counting toner amounts per page for the respective colors to be consumed, and registers for separately storing the accumulated toner amounts per page for the respective colors. The counters are each controlled in such a way as to perform or not perform a count operation depending on a decoded signal indicative of the image characteristics information 3003 decoded from a decoder 8008. The decoder 8008 generates an enable signal when the toner amount accumulative counters 8003, 8004, and 8005 are to perform the count operation.

Figure 16:
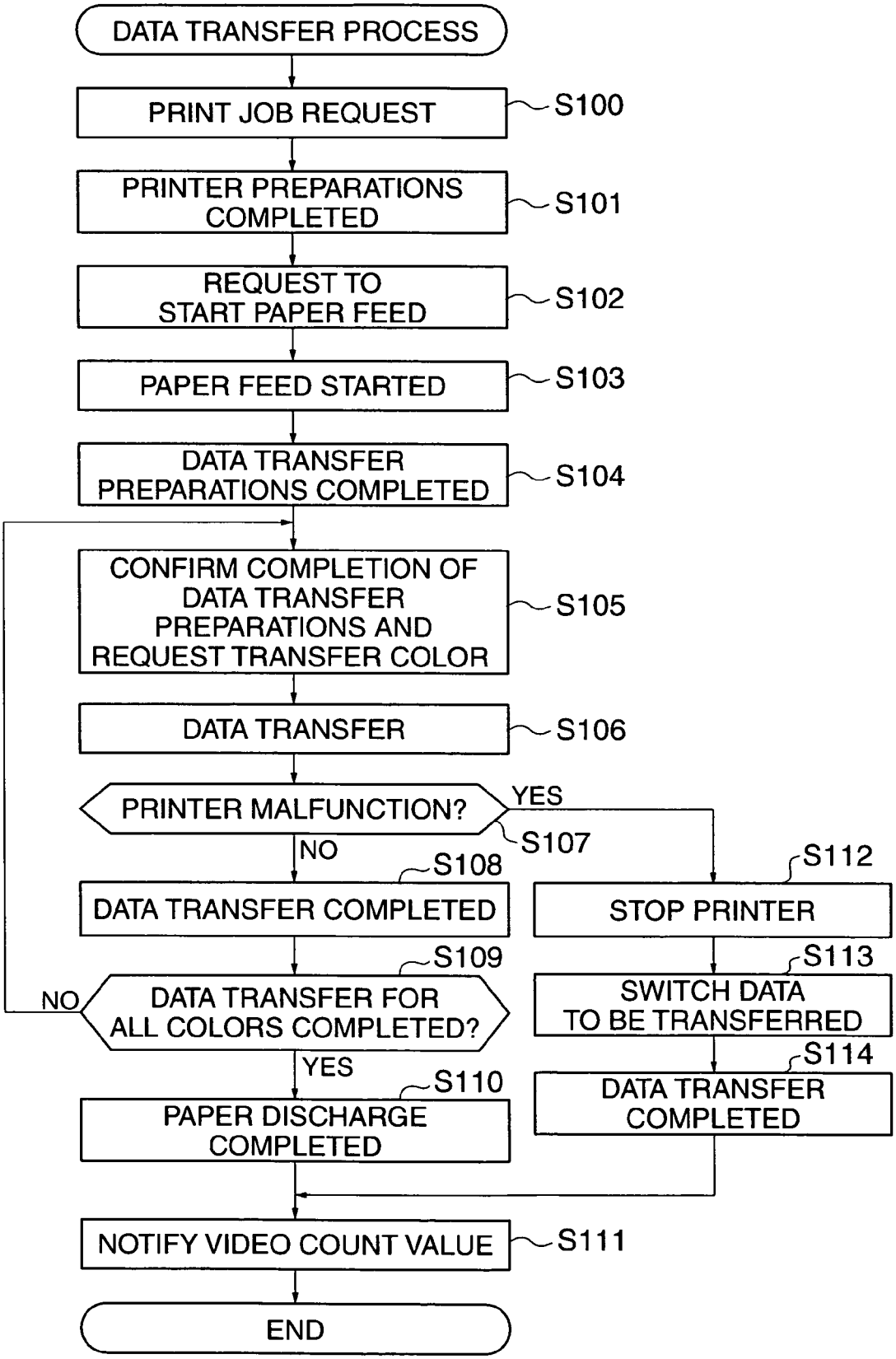
FIG. 16 is a flow chart of a data transfer process executed by the controller and the printer engine controller appearing in FIG. 2.

FIG. 16 is a flow chart of a data transfer process executed when the controller 1001 shown in FIG. 4 transfers image data to the printer engine controller 2200. It should be noted that the present process is executed before execution of the video count process shown in FIG. 17.

When image data is output from the controller 1001 to the printer engine controller 2200 of the printer section 1003, as described above, serial communications are performed between the controller 1001 and the printer engine controller 2200 through a serial bus and a job according to the present process is executed while each unit ascertains the status of the other unit.

In FIG. 16, first, to start a print job, the controller 1001 requests the printer engine controller 2200 to make preparations for an image forming process, by notifying that a print job has been sent to the printer engine controller 2200 (step S100). If the printer section 1003 is not in a state of executing a patch density detecting process or some other adjusting process but is in a state in which it can receive a data packet including image data from the controller 1001, the printer engine controller 2200 notifies the controller 1001 that the printer 1003 has completed preparations and is in a ready state (step S101).

Next, when it is confirmed that the printer section 1003 is ready, the controller 1001 requests the printer engine controller 2200 to start paper feed (step S102). When a request to start paper feed is received, the printer engine controller 2200 starts feeding recording material paper from the recording material cassette 7 and also notifies the controller 1001 that paper feed has started (step S103).

When the paper supply at the printer section 1003 has started, the controller 1001 causes the system controller 2150 in FIG. 4 to set parameters for designating image data to be output, read out the image data from the HDD 1035 and store the same in the RAM 1021 as the main memory. When preparations for the generation of page data in the RAM 1021 are completed, the controller 1001 notifies the printer engine controller 2200 that transfer preparations have been completed (step S104).

Upon receiving the notification from the controller 1001 that the image transfer preparations are completed, the printer engine controller 2200 sends a notification back to the controller 1001 that the notification has been received and confirmed and at the same time, requests a transfer color that is a type of color to be transferred in accordance with the print order from among the four colors CMYK (step S105).

The controller 1001 performs setting of parameters according to the color to be transferred, requested by the printer engine controller 2200, at the image processor 1041 and the printer section image processor 1061, reads the data packet including the image data from the RAM 1021, and DMA transfers the image data of the requested transfer color to the printer section 1003 via the image ring 1040, the image processor 1041, the printer section image processor 1061 and the SCI 2209 (step S106). In addition, the video count process shown in FIG. 17, described later, is executed in response to and parallel to the start of the process of the step S106.

When image formation is performed normally, without generation of a printer malfunction interrupt for notifying a printer malfunction due to a jam or the like (i.e., "YES" to a step S107), the controller 1001, upon receiving a data transfer completion notification from the printer section image processor 1061 (step S108), determines whether or not data transfer for all colors CMYK has been completed (step S109). If the results indicate that data transfer of all colors has not been completed, then the process returns to the step S105 where image data of the next color requested by the printer engine controller 2200 is transferred. In the manner thus described, the series of sequences is repeated until data transfer for all the four colors CMYK is completed.

Figure 17:
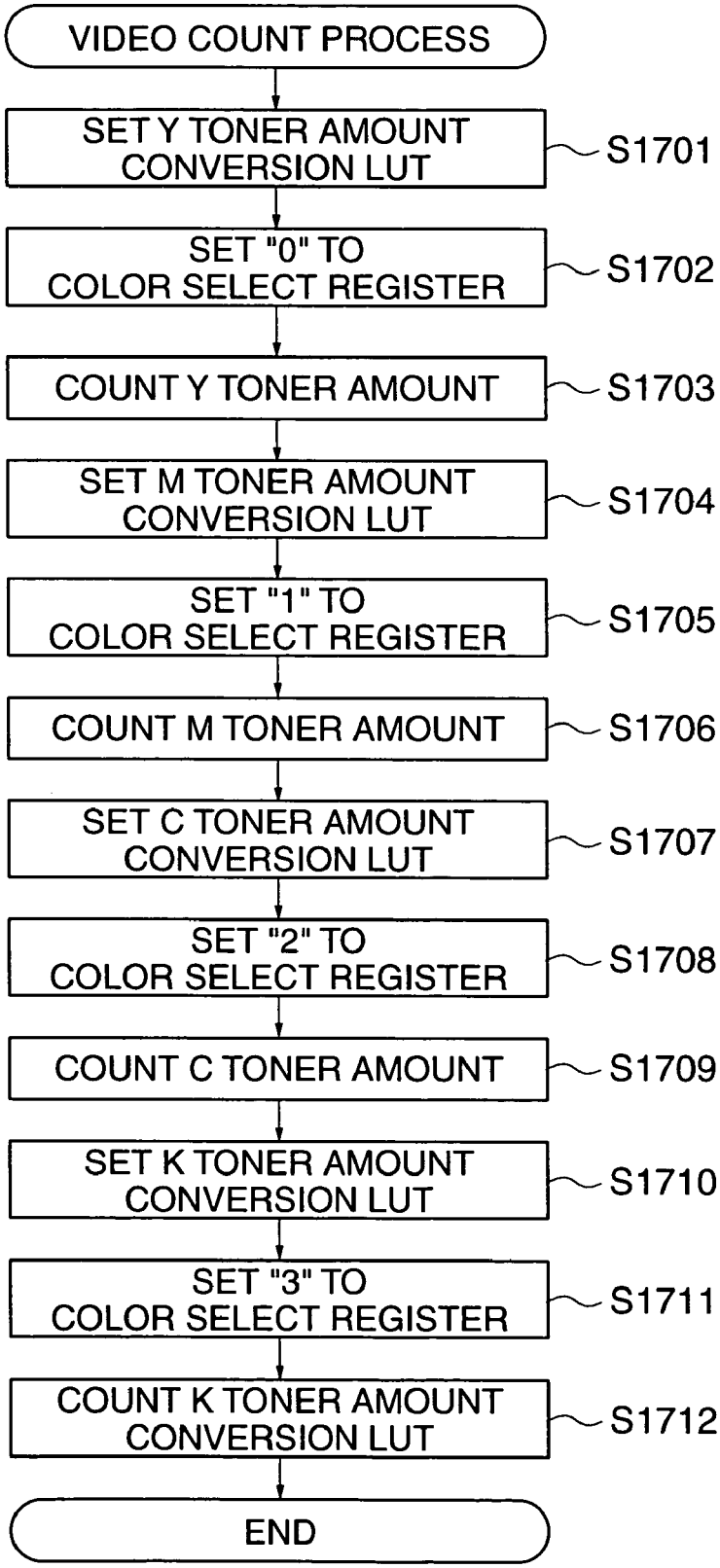
FIG. 17 is a flow chart showing a video count process executed by the video counter shown in FIGS. 15A and 15B (common to the first embodiment and a second embodiment)

On the other hand, if data transfer for all the colors has been completed, then the controller 1001 terminates the video count process shown in FIG. 17 and at the same time receives a discharge completion notification from the printer engine controller 2200 after a predetermined period of time has elapsed (step S110) and notifies as video count values the accumulated amounts of toner of each color stored in the registers in the toner amount accumulative counters 8003 to 8005 to the printer engine controller 2200 (step S111). By virtue of the provision of the registers in the toner amount accumulative counters 8003 to 8005 and the video count value notification process of the step S111, the amount of the consumable material to be consumed can be accumulated independently for each color image of multicolor image data based on image data input from an external source, and further, the amounts of consumable material for the respective colors to be consumed accumulated independently for each color image of multicolor image data can be stored, so that the correct amount of the consumable material to be consumed for each color can be determined by notifying the printer engine controller 2200 of the stored amount of the consumable material to be consumed. Accordingly, more accurate consumable material supply can be performed.

The printer engine controller 2200 supplies toner to the developing devices of the respective colors based on the accumulated color toner amounts notified. Control of the amount of toner supplied may, for example, be executed by a method of adjusting the length of time in which toner is supplied to the developing devices, but the present invention is not particularly limited to such method. Moreover, the conversion from accumulated color toner amounts to toner supply amounts may be accomplished by providing a correlation table in the printer engine controller 2200 or may be calculated by computations of the CPU 2201 in the printer engine controller 2200, but in any case the present invention is not limited whatsoever to the techniques thus described. Moreover, the toner supply amounts that are the results of calculations by the controller 1001 based on the accumulated color toner amounts may be notified to the printer engine controller 2200 and the toner supply process performed.

The foregoing processes are performed when image formation is performed normally. However, where a printer malfunction interrupt is issued before execution of the step S107 (that is, "NO" to the step S107), the printer stops (step S112). In such cases, the system controller 2150 of the controller 1001 promptly executes a switching process which is executed when a video count malfunction is generated, shown in FIG. 18, described later, to set the value of the image data that is being counted by the video counter 9032 to the fixed value (step S113). Upon receiving a data transfer completion notification from the printer section image processor 1061 (step S114), the controller 1001 terminates the switching process shown in FIG. 18 and notifies the printer engine controller 2200 of the accumulated color toner amounts for the respective colors stored in the registers in the toner amount accumulative counters 8003 to 8005 in the video counter 9032, and the process is terminated.

Next, a description will be given of the operation of the video counter 9032, with reference to FIG. 17.

FIG. 17 is a flow chart showing the video count process executed by the video counter 9032 shown in FIGS. 15A and 15B.

In the video count process, counting is made of the amount of the consumable material to be consumed when data having been subjected to image processing based on image data input from an external source is transferred to the printer section 1003. It should be noted that in this video count process the order of color transfer when transferring image data to the printer section 1003 is Y→M→C→K.

In FIG. 17, first, in a step S1701, since Y is requested as a first color of transfer colors by the printer engine controller 2200 in the step S105 in the flow chart of FIG. 16 described above, the controller 1001 sets a Y toner amount conversion table in the three LUTs of the image data (density)-toner amount converter 8000 of the video counter 9032.

Next, in a step S1702, the value of the color select register 8007 is set. In the present embodiment, the select values are Y:0, M:1, C:2 and K:3, and the banks are Y:0, M:1, C:0 and K:1, and therefore, to select Y, the color select register 8007 is set to "0" and the selector 8002 selects the bank 0 (that is, the image data-toner amount converter 8000). Moreover, the registers of the toner amount accumulative counters 8003, 8004 and 8005 are set so that only the Y registers are effective.

In a step S1703, when a data transfer request is received from the printer engine controller 2200 and data transfer is started in the step S106 in FIG. 16, image data from the color balance corrector 9011 starts to be input to the video counter 9032 as well. The input image data is converted into a toner amount by the image data-toner amount converter 8000 or 8001 and input to one of the toner amount accumulative counters 8003, 8004 and 8005 via the selector 8009.

Image characteristics information is also input to the video counter 9032 together with the image data, and the controller 1001 selects the toner amount accumulative counter that is to perform the toner amount count process from among the toner amount accumulative counters 8003 to 8005 according to the type of halftone processing selected based on the input image characteristics information (or image data type) which changes with each pixel of the image data DMA transferred by the transfer means. Specifically, the image characteristics information includes signals whose signal levels change in pixel units, such as the PDL data font identification signal and the scanned image character area determining signal. Therefore, it is necessary to switch the type of halftone processing performed in pixel units or in units of predetermined images depending on the characteristics information (or type of image data). The LUTs and the toner amount accumulative counters 8003, 8004 and 8005 are switched in response to the switching of the halftone process.

Further, because the toner supply amount that the printer engine controller 2200 obtains by converting from the accumulated toner amounts notified by the controller 1001 varies in conversion rate according to the content of the halftone processing, it is necessary to count the toner amount with each halftone process. Similarly, with respect to the counts performed by the toner amount accumulative counters 8003, 8004 and 8005 as well, it is necessary to control the count operation in pixel units.

The decoder 8008 decodes the input image characteristics information and supplies an enable signal which varies in pixel units to the toner amount accumulative counters 8003, 8004 and 8005. For example, if the halftone processing type A is selected when the data belongs to a character area in a scanned image, then when bit 2 of the image characteristics information is "1", the enable signal (bit 0) sent to the toner amount accumulative counter 8003 is activated. If the halftone processing type B is selected for PDL font data, then when bit 1 of the image characteristics information is "1", the enable signal (bit 1) sent to the toner amount accumulative counter 8004 is activated. If the halftone process type C is selected for all other image information, then the enable signal (bit 2) sent to the toner amount accumulative counter 8005 is activated when any of the other image information is input.

At the enabled toner amount accumulative counters 8003, 8004 and 8005, in accordance with the enable signals input from the decoder 8008, the amount of toner at each pixel of the color input (here, Y) is counted and accumulated. Then, when transfer of data for one page is completed, the accumulated toner amount of yellow is stored in the Y registers (step S1703).

In a step S1704, when M is requested as a second transfer color by the printer engine controller 2200, the controller 1001 sets an M toner amount conversion table in the three LUTs of the image data toner amount converter 8001 (bank 1) of the video counter 9032.

In a step S1705, "1" is set to the color select register 8007. The selector 8002 selects the bank 1 (image data toner amount converter 8001). Moreover, at the enabled toner amount accumulative counters 8003, 8004 and 8005 only the M registers are set to be effective.

In a step S1706, as in the step S1703, at the enabled toner amount accumulative counters 8003, 8004 and 8005, an M toner amount is counted and accumulated and the accumulated toner amount is stored in the M registers.

In a step S1707, when C is requested as a third transfer color by the printer engine controller 2200, the controller 1001 sets an M toner amount conversion table in the three LUTs of the image-data toner amount converter 8000 (bank 0) of the video counter 9032.

In a step S1708, "2" is set to the color select register 8007. The selector 8002 selects the bank 0 (image data-toner amount converter 8000). Moreover, at the enabled toner amount accumulative counters 8003, 8004 and 8005 only the C registers are set to be effective.

In a step S1709, as in the step S1703, at the enabled toner amount accumulative counters 8003, 8004 and 8005, a C toner amount counted and accumulated and the accumulated toner amount is stored in the C registers.

In a step S1710, when K is requested as a fourth transfer color by the printer engine controller 2200, the controller 1001 sets a K toner amount conversion table in the three LUTs of the image data toner amount converter 8001 (bank 1) of the video counter 9032.

In a step S1711, "3" is set to the color select register 8007. The selector 8002 selects the bank 1 (image data toner amount converter 8001). Moreover, at the enabled toner amount accumulative counters 8003, 8004 and 8005 only the K registers are set to be effective.

In a step S1712, as in the step S1703, at the enabled toner amount accumulative counters 8003, 8004 and 8005, a K toner amount is counted and accumulated and the accumulated toner amount is stored in the K registers.

It should be noted that, in the process shown in FIG. 17, the LUTs of the image data-toner amount converters 8000 and 8001 are updated when there is a request for color transfer from the printer engine controller 2200. If the order of the colors of the image data to be transferred is known in advance, however, the image data toner amount converters may be toggled so that the setting of the LUTs for the second color (M) in the image data toner amount converter 8001 is performed while the data for the first color (Y) is being transferred, the setting of the LUTs for the third color (C) in the image data-toner amount converter 8000 is performed while the data for the second color (M) is being transferred, . . . and so forth, to thereby make it possible to reduce the transfer time of the image data of the four colors.

Further, where the printer section 1003 is a tandem printer having a plurality of photosensitive drums, two video counters 9032 may be provided and image data of each of the color components CMYK may be input to the image data-toner amount converters 8000 and 8001.

Where it is determined that a jam or other such sudden malfunction has occurred during image output in the step S107 shown in FIG. 16, the printer engine controller 2200 issues an interrupt to the controller 1001 and stops the printer engine (step S112 in FIG. 16). The controller 1001 in turn continuously looks for input of an interrupt signal during data transfer.

Where the controller 1001 uses DMA transfer for the image data transfer from the RAM 1021, the controller 1001 must stop DMA transfer so as not to conduct a video count based on unneeded image data. However, to stop the DMA transfer, control becomes complicated because exceptional processing occurs at the system controller 2150. Therefore, in the present embodiment, a configuration is adopted in which exceptional processing can be performed simply, merely by register setting of the video counter 9032, without stopping DMA transfer whenever the printer engine stops image formation due to the occurrence of a malfunction.

Processing performed by the video counter 9032 when this sort of malfunction occurs will be described by referring to FIG. 18. It is assumed that until a malfunction interrupt is notified the video count process shown in FIG. 17 continues to be performed.

Figure 18:
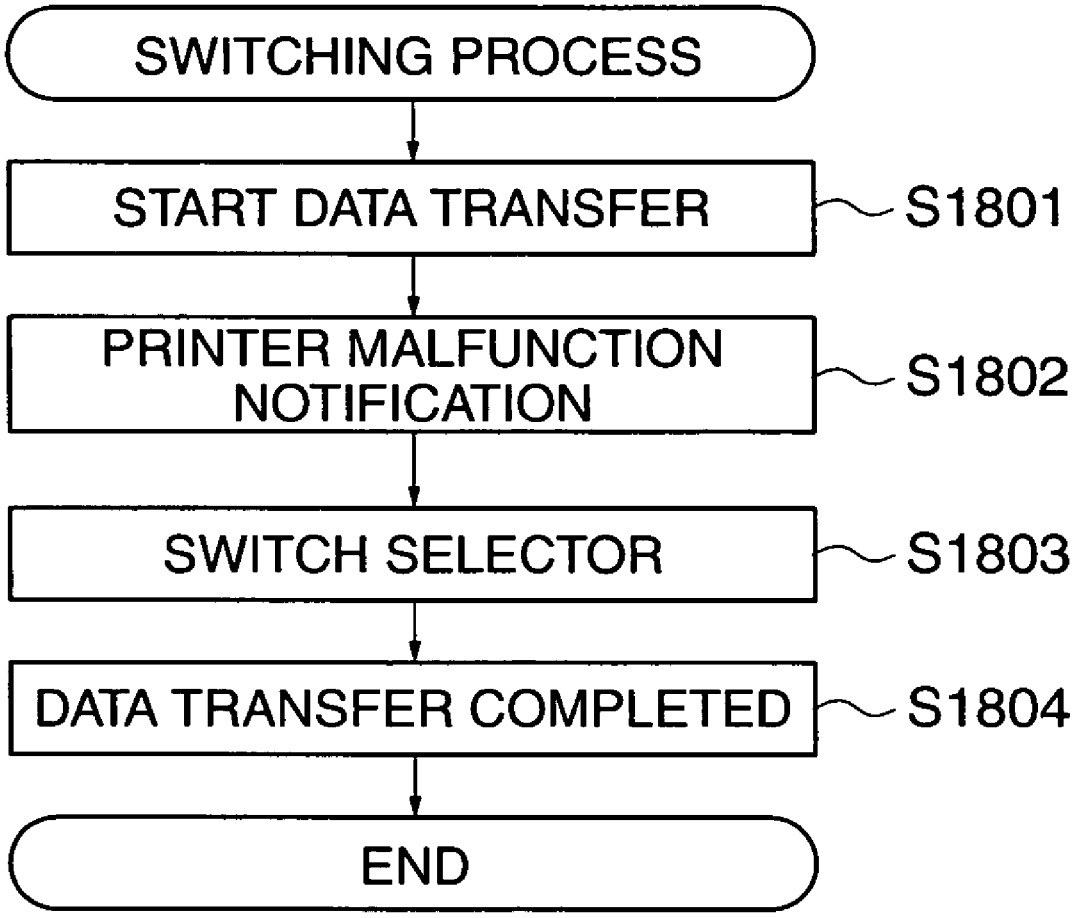
FIG. 18 is a flow chart showing a switching process executed by the video counter shown in FIGS. 15A and 15B when a video count malfunction occurs.

FIG. 18 is a flow chart showing a switching process executed by the video counter 9032 shown in FIGS. 15A and 15B when a video count malfunction occurs.

In the present process, where the image forming process performed by the image forming apparatus 2001 is interrupted because a malfunction has occurred, image data for which a fixed value is set as the video count value (hereinafter referred to as "the fixed value data") is set as data to be transferred by the transfer control means, in place of image data input as data to be transferred, so that a count process based on the input image data is not performed. Specifically, the image data that is the object of the count performed by the video counter 9032 is promptly switched to the fixed value data and DMA transfer of the switched fixed value data via the video interface is started. Then, the toner amount accumulative counting process shown in the steps S1703, S1706, S1709 and S1712 in FIG. 17 is continued based on the DMA transfer of the switched fixed value data.

In FIG. 18, first, in a step S1801, the image data that is the object of transfer is input to the video counter 9032.

In a step S1802, a malfunction is notified by an interrupt from the printer engine controller 2200.

In a step S1803, the system controller 2150 of the controller 1001 promptly changes the setting of the data selector register 8010 so that the video counter 9032 selector 8009 outputs the fixed value data of the fixed value setting register 8006, to thereby essentially render ineffective the functioning of the video count process of the video counter 9032 based on image data input from an external source without stopping the transfer process by DMA transfer unnecessarily where processing performed by the engine (image forming means) stops because of a malfunction of some sort. As a fixed value set in the fixed value data of the fixed value setting register 8006, there is previously set a value that corresponds to white, for example. In the present embodiment, the input image data corresponds to the colors CMYK, and therefore the fixed value is "0".

By outputting the fixed value data corresponding to white from the fixed value setting register based on control of the selector 8009, the toner amount at the image data toner amount converters 8001, 8002 is changed to "0", that is, the toner amount accumulative counters 8003, 8004 and 8005 do not substantially count the amount of toner to be consumed by the print process. Thus, where the printer engine is stopped and in actuality toner ceases to be consumed, the video count function also substantially stops (that is, is rendered ineffective), and therefore the accumulated toner amount obtained by the video count operation faithfully reflects the amount of toner actually consumed by the printer engine, making it possible to maintain the toner density at the printer section 1003 constant at all times.

It should be noted that, where luminance-type image data such as RGB is input, white assumes the maximum value that can be expressed in the bit length of the input image data ("255" if 8-bit input image data), and therefore the maximum value may be set in the fixed value setting register 8006.

Moreover, where the fixed value data corresponding to white set in the fixed value setting register 8006 is output to the toner amount accumulative counters 8003, 8004 and 8005, the fixed value data corresponding to white is transferred to the printer engine controller 2200 as well, without stopping the DMA transfer operation of the actual image data.

In other words, as shown in FIG. 4, the printer section image processor 1061 having the video counter 9032 is disposed between the image DMA sections a 1016 and b 1017 that perform DMA transfer and the printer section 1003. Therefore, even when a malfunction occurs at the printer section 1003, the image DMA sections a 1016 and b 1017 continue to perform DMA transfer of the image data in the RAM 1021, and the printer section image processor 1061 discards the image data transferred by DMA transfer and transfers the fixed value data corresponding to white set in the fixed value setting register 8006 to the printer section 1003.

In a step S1804, when transfer of image data for one page of the color (including fixed value data corresponding to white) being transferred when notice of a malfunction is received is completed, the controller 1001 stops the transfer of image data of the subsequent colors and notifies the printer engine controller 2200 of the accumulated toner amounts for one page for all the halftone processing types and all the colors.

Although in the present embodiment, after a malfunction occurs, the fixed value of the fixed value data corresponding to white is subjected to the video count to thereby substantially stop the video count function without stopping transfer of the image data by DMA, etc., other methods, for example, stopping the enablement of the toner amount accumulative counters 8003, 8004 and 8005 may be used, provided that such other methods substantially stop the video counter 9032 count function.

Moreover, in addition to the DMA transfer, the video count process according to the present embodiment can also be applied to a case in which the transfer of image data cannot be stopped midway even when a malfunction occurs at the printer section 1003, such as when the printer section 1003 performs a print operation in synchronism with a scan operation of the scanner section 1002.

Next, a description will be given of an image forming apparatus according to a second embodiment of the present invention, with reference to FIGS. 19 to 23. In these figures, elements and parts corresponding to those in the first embodiment described above are designated by identical reference numerals, and description thereof is omitted.

The second embodiment is distinguished from the first embodiment in that in the second embodiment, upon receipt of a notification of occurrence of an abnormality from the printer section 1003, a video count value then assumed and corresponding to a line which is closest to a line in the sub-scanning direction of the image data that is transferred is notified to the printer engine controller 2200.

Figure 19:
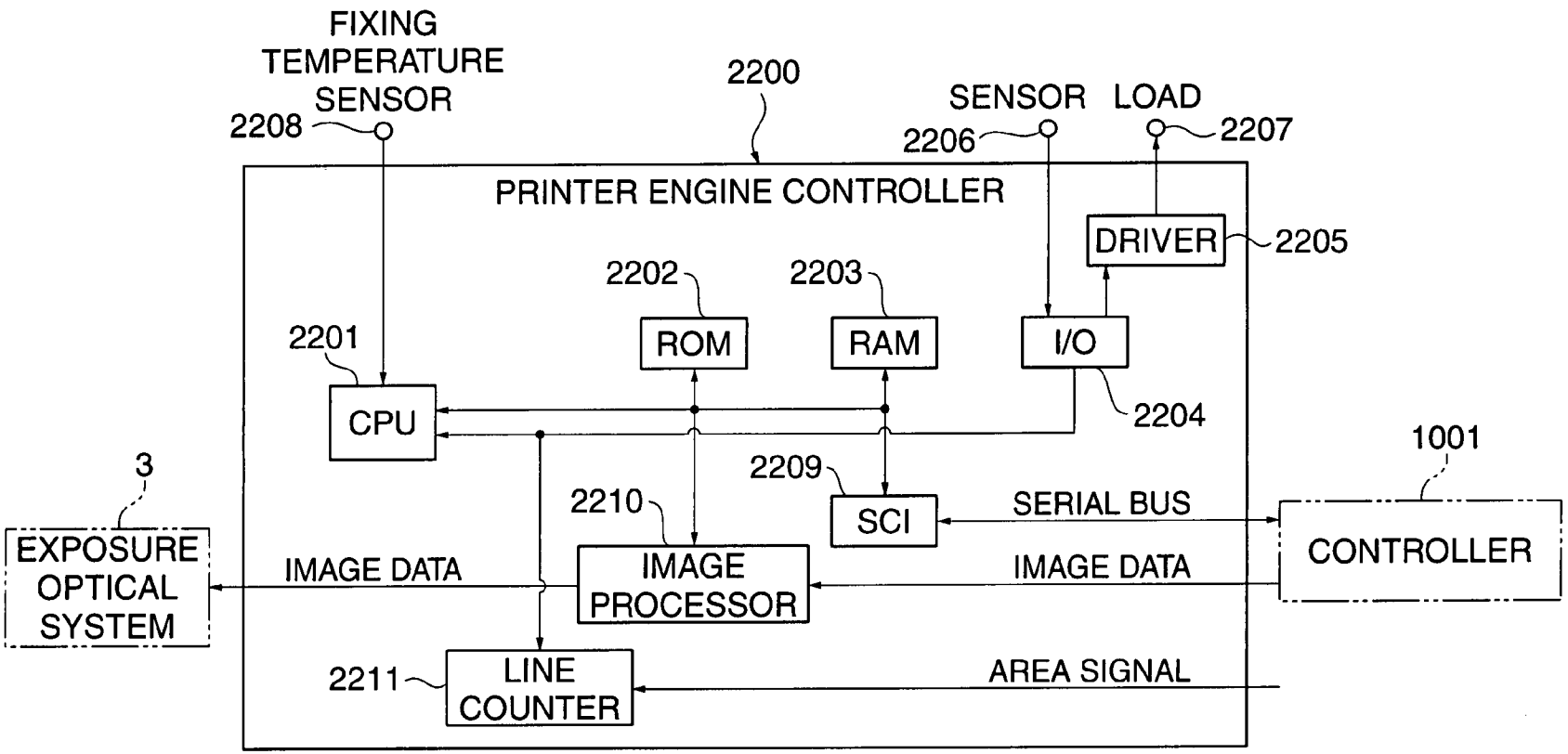
FIG. 19 is a block diagram showing the configuration of a printer engine controller of an image forming apparatus according to a second embodiment of the present invention.

FIG. 19 is a block diagram showing the configuration of a printer engine controller 2200 of an image forming apparatus according to the second embodiment.

As shown in FIG. 19, the printer engine controller 2200 of the printer section 1003 includes a line counter 2211. The line counter 2211 counts area signals indicative of an effective area of image data transferred from the controller 1001 and transmits a line count value expressing the number of pixels in the direction of conveyance of a recording material such a printing sheet, to the CPU 2201.

In the present embodiment, the printer section image processor 1061 is exactly the same in construction as the printer section image processor 1061 of the first embodiment shown in FIG. 14, except the contents of the processing performed by the input I/F 9001.

More specifically, in the second embodiment, the I/F 9001, like the first embodiment, changes the clock frequency of the image data input from the image processor 1041 to the clock frequency of the printer section image processor 1061. However, the I/F 9001 also generates a horizontal enable area signal "h-enable" and a vertical enable area signal "v-enable" as area signals expressing the effective area of the input image data used in the printer section image processor 1061. These area signals express an area corresponding to the size of a sheet output from the printer. Thus, the "h-enable" area signal expresses the effective area in the main scanning direction that corresponds to the scanning direction of the polygon mirror 3*a*, and the "v-enable" area signal expresses the effective area in the sub-scanning direction corresponding to the direction of conveyance of the recording material. Both signals assume "0" when the area indicated thereby lies within the effective area and assume "1" when the area lies within an ineffective area.

These area signals "h-enable" and "v-enable" are used as enable signals for controlling a mask process that prevents image data processed by the printer section image processor 1061 from being printed beyond the sheet and for controlling the operation of the modules in the printer section image processor 1061.

Figure 20A:
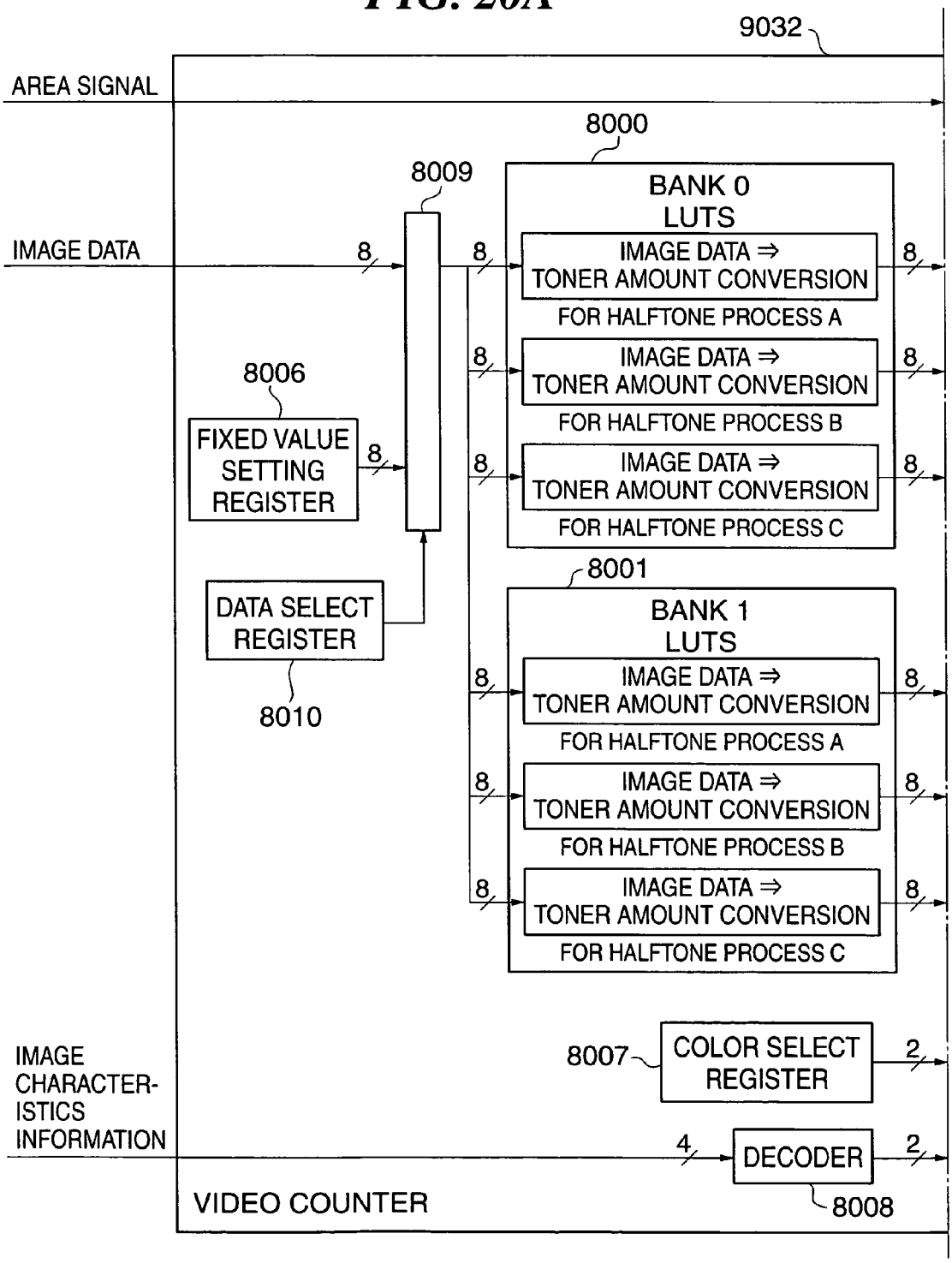
FIGS. 20A and 20B are block diagram showing the configuration of a video counter of the second embodiment.
Figure 20B:
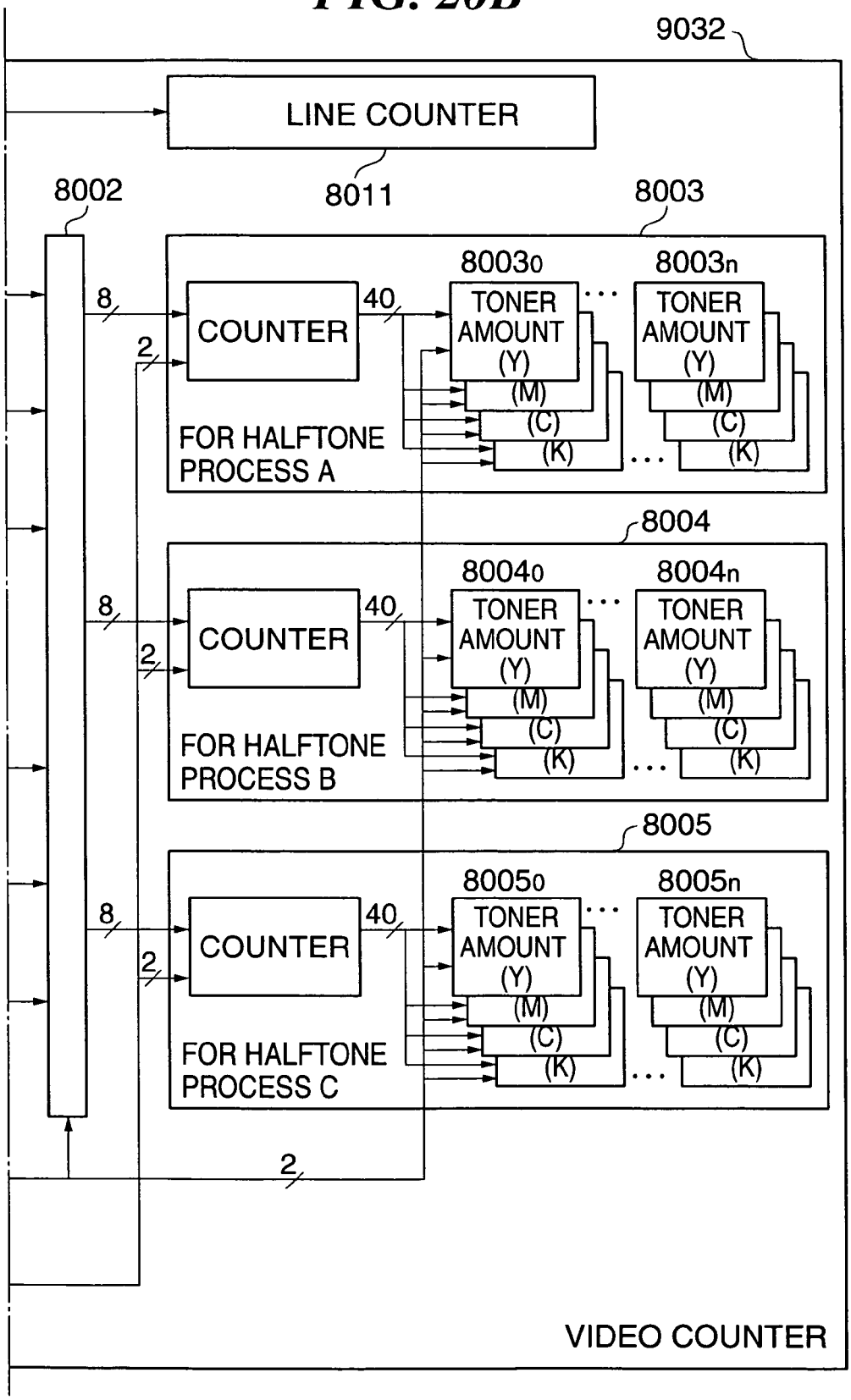

Moreover, in this second embodiment, the video counter 9032 includes a line counter 8011 as shown in FIG. 20B. The line counter 8011 counts the number of lines in the sub-scanning direction of the image data (hereinafter referred to as "the number of lines") when it detects a trailing edge of the input area signal "h-enable".

The toner amount accumulative counters 8003, 8004 and 8005 include a plurality of registers $\mathbf{8003}_0$ to $\mathbf{8003}_n$, $\mathbf{8004}_0$ to $\mathbf{8004}_n$ and $\mathbf{8005}_0$ to $\mathbf{8005}_n$, respectively, separately provided for the respective colors YMCK. It should be noted that, preferably the number of registers n corresponding to the same color is set to a number of lines used when printing on a printing sheet of the maximum printable size. However, where it is desirable to reduce the memory capacity, the number of registers n may be set to a number less than the number of lines, in so far as the toner density does not change greatly.

Although in FIG. 20A, the fixed value setting register 8006 and data select register 8010 are also provided in the video counter 9032 as with the first embodiment, these registers may be omitted from the second embodiment. In other words, in the second embodiment, after a malfunction has occurred at the printer section 1003, either white dummy data (fixed value data) may be transferred or the actual or original image data may be transmitted (corresponding to a step S114 shown in FIG. 21, described later).

Figure 21:
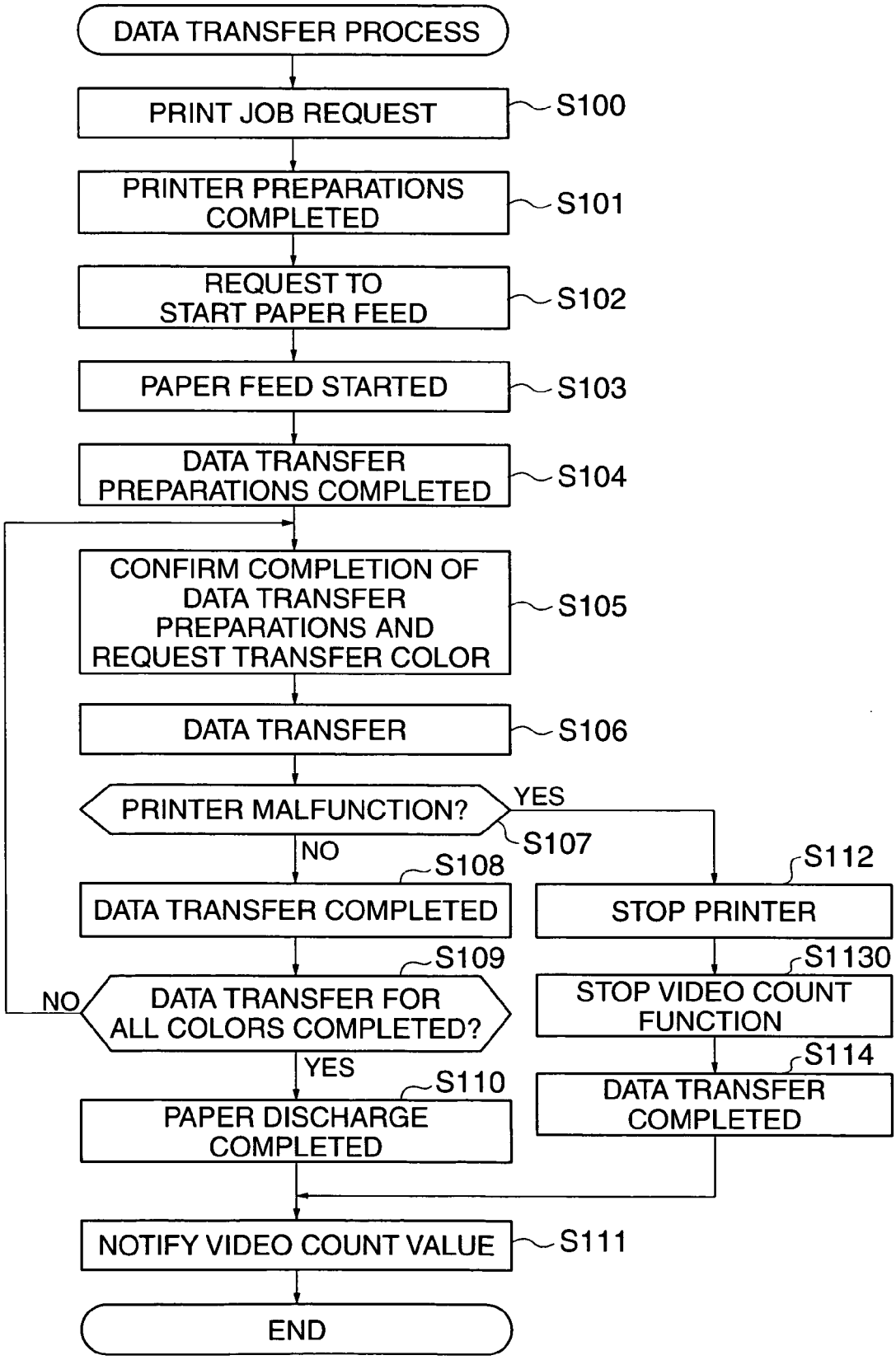
FIG. 21 is a flow chart showing a data transfer process executed by the image forming apparatus according to the second embodiment.

FIG. 21 is a flow chart showing a data transfer process executed in the second embodiment. It should be noted that most of the steps shown in FIG. 21 are identical to those shown in FIG. 16, and therefore are assigned identical reference numerals and description thereof is omitted.

As shown in FIG. 21, in a step S1130, the controller 1001 performs a function termination process for the video counter 9032, shown in FIG. 23, described later, instead of the step S113 shown in FIG. 16.

Further, in a step S111 in FIG. 21, the controller 1001 notifies the printer engine controller 2200 of the accumulated amounts of toner stored in the accumulated toner amount storage registers $\mathbf{8003}_0$ to $\mathbf{8003}_n$, $\mathbf{8004}_0$ to $\mathbf{8004}_n$ and $\mathbf{8005}_0$ to $\mathbf{8005}_n$ of numbers (0-n) stored in a number storage register, described later, provided in the line counter 8011 inside the video counter 9032. It should be noted that a portion of the processes shown in FIG. 23 overlap the processes of steps S1130 and S114 shown in FIG. 21.

In the second embodiment as well, as with the first embodiment, the series of video count processes like those shown in FIG. 17 is performed. However, the contents of the toner amount accumulative counting processes of steps S1703, S1706, S1709 and S1712 are different from those of the first embodiment. Details of the toner amount accumulative counting processes (the video count process) of the second embodiment will be described with reference to FIG. 22.

Figure 22:
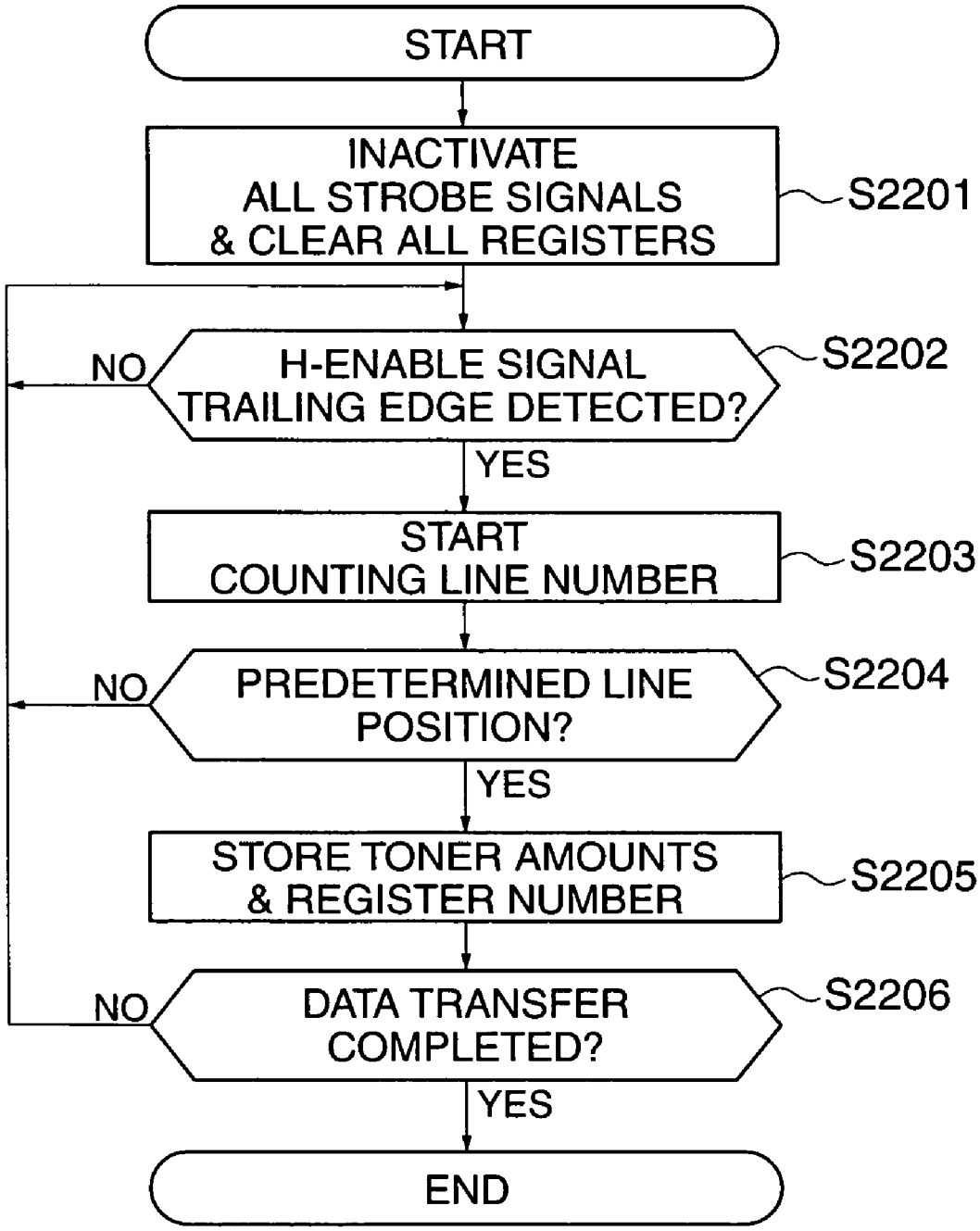
FIG. 22 is a flow chart showing a video count process executed by the video counter shown in FIGS. 20A and 20B.

FIG. 22 is a flow chart showing a video count process executed by the video counter 9032 shown in FIGS. 20A and 20B.

As shown in FIG. 22, first, in a step S2201, when data transfer to the printer section 1003 is started, the line counter 8011 renders inactive (for example, sets to "0") strobe signals for all the accumulated toner amount storage registers $\mathbf{8003}_0$-$\mathbf{8003}_n$, $\mathbf{8004}_0$-$\mathbf{8004}_n$ and $\mathbf{8005}_0$-$\mathbf{8005}_n$. Moreover, the toner amount accumulative counters 8003, 8004 and

8005 set to "0" or clear the accumulated toner amount storage registers $\mathbf{8003}_0$-$\mathbf{8003}_n$, $\mathbf{8004}_0$-$\mathbf{8004}_n$ and $\mathbf{8005}_0$-$\mathbf{8005}_n$.

Next, in steps S2202, S2203 and S2204, after a trailing edge of the v-enable area signal is detected ("YES" to the step S2202), the line counter 8011 starts counting the number of lines at a time point at which a trailing edge of the h-enable area signal is detected (step S2203), and the above-described steps S2202, S2203 and S2204 are repeated until the number of lines counted reaches a predetermined number of lines (line position) ("YES" to the step S2204).

In a step S2205, the line counter 8011 renders a corresponding strobe signal active (for example, setting the signal to "1") when the number of lines counted reaches the predetermined number of lines.

A plurality of strobe signals (0-n) are provided in the line counter 8011, so as to enable the toner amount accumulative counters 8003, 8004 and 8005 to recognize that line positions within a single page have been reached. Moreover, the number of lines needed to render the strobe signal active is set in a register provided inside the line counter 8011.

That is, in other words, when the number of lines counted reaches a first predetermined number of lines, the line counter 8011 renders the strobe signal (0) active (for example, "1") and again renders the strobe line inactive (for example "0") when the count proceeds to the next line.

When the strobe signal (0) is rendered active, the toner amount accumulative counters 8003, 8004 and 8005 store the accumulated toner amounts so far counted in the registers $\mathbf{8003}_0$, $\mathbf{8004}_0$ and $\mathbf{8005}_0$ corresponding to the color of the image data transferred up to that point.

Moreover, a number storage register for storing the number assigned to the registers for which accumulated toner amount storage is completed is provided in the line counter 8011. When accumulated toner amount storage is completed, the number assigned to the registers for which storage of the toner amount is completed is stored in the number storage register ("0" at this time point).

In a step S2206, if transfer of image data of the colors of a single page has not been completed, the process returns to the step S2202 and the line counter 8011 continues to count the number of lines. When the next predetermined number of lines is reached, the line counter 8011 renders the strobe signal (1) active.

When the strobe signal (1) is rendered active, the toner amount accumulative counters 8003, 8004 and 8005 store the accumulated toner amounts so far counted in the registers $\mathbf{8003}_1$, $\mathbf{8004}_1$ and $\mathbf{8005}_1$ corresponding to the color of the image data transferred up to that point. At this time, the line counter 8011 updates the value of the number storage register (the register number) from "0" to "1".

Thereafter, by the same operation the accumulated toner amount is stored in the corresponding registers up to nth registers, and each time it is stored, the number storage register inside the line counter 8011 is updated.

Where the operation has normally terminated, the value of the number storage register is "n" and the printer engine controller 2200 is notified of the accumulated amounts of toner in the registers $\mathbf{8003}_n$, $\mathbf{8004}_n$ and $\mathbf{8005}_n$ of the colors transferred.

In the second embodiment as well, for the same reasons as described in relation to the first embodiment, a configuration is adopted in which, where the printer engine has stopped image formation due to a malfunction of the printer section 1003, exceptional processing can be performed simply, merely by register setting of the video counter 9032, without stopping the transfer (including the DMA transfer) of image data to the printer section 1003.

Figure 23:
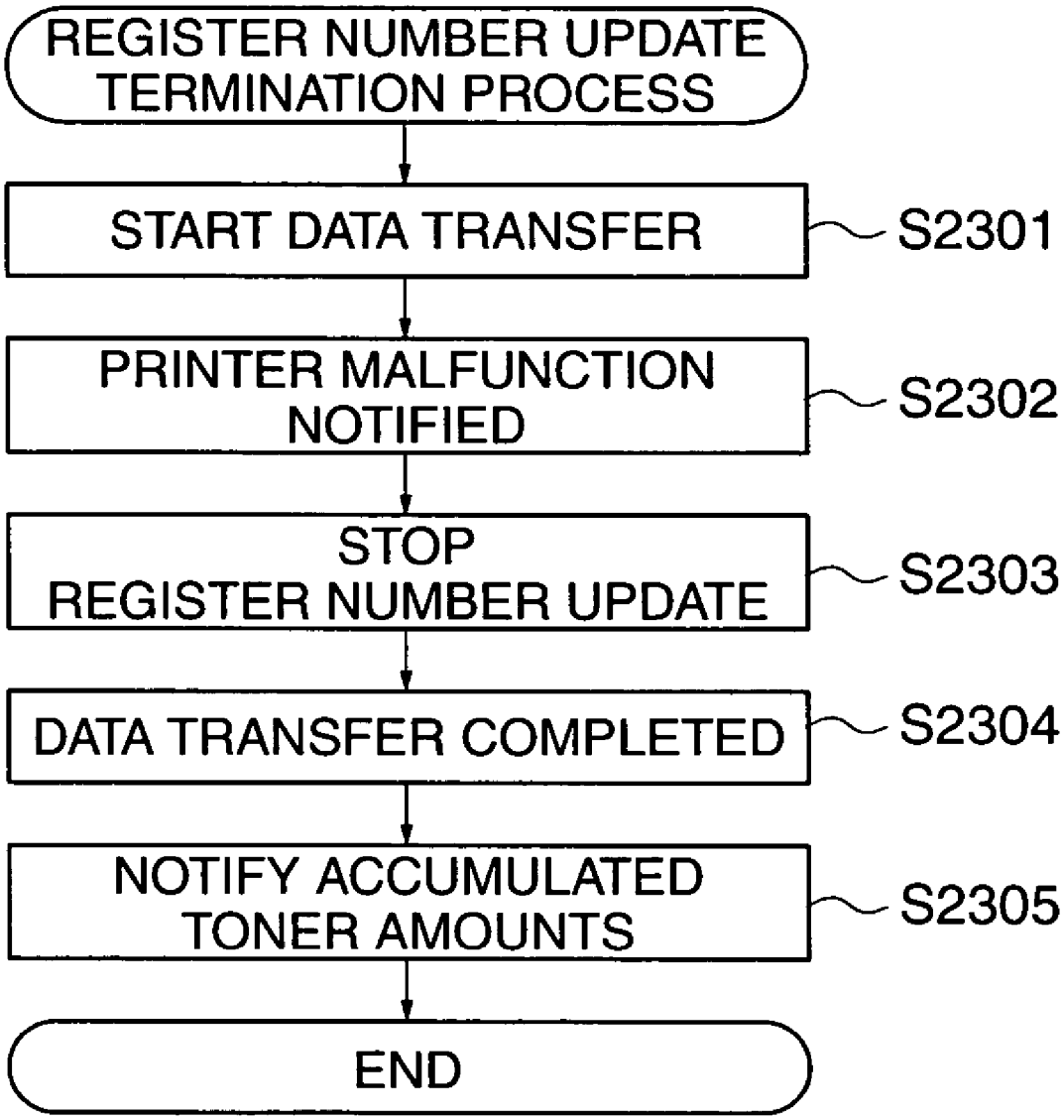
FIG. 23 is a flow chart of a register number update termination process executed by the video counter shown in FIGS. 20A and 20B when a video count malfunction occurs.

FIG. 23 is a flow chart of a register number update termination process executed by the video counter 9032 shown in FIGS. 20A and 20B when a video count malfunction occurs.

As shown in FIG. 23, first, in a step S2301, the controller 1001 transfers image data of each color to the printer engine controller 2200 as shown in the steps S1703, S1706, S1709 and S1712 shown in FIG. 17.

Next, in a step S2302, when the controller 1001 is notified of a printer engine malfunction by an interrupt from the printer engine controller 2200, the system controller 2150 of the controller 1001 promptly stops the updating of the register number in the number storage register of the line counter 8011 (step S2303).

It should be noted that, in the present embodiment, even after updating of the register number is stopped, the toner amount accumulative counters continue the count process and the line counter 8011 continues the process of counting the number of lines as well as the process of outputting (activating) the strobe signal.

In a step S2304, when transfer of a color of image data for one page which is being performed at a time a malfunction notification is received is completed, the accumulated amounts of toner in the accumulated toner amount storage registers are notified (step S2305). Specifically, if the register number that the line counter 8011 holds in the storage number register, that is, the register number in the state in which the malfunction notification is received and the updating is stopped is "m", the accumulated toner amounts in the accumulated toner amount storage registers $\mathbf{8003}_m$, $\mathbf{8004}_m$ and $\mathbf{8005}_m$, are notified to the printer engine controller 2200. These notified accumulated toner amounts are in actuality the amounts of toner consumed stored in the accumulated toner amount storage registers having the register number updated just before the reception of the malfunction notification.

Where the printer engine is stopped, the controller 1001 terminates the print job when the toner amount notification is completed.

As described above, in the second embodiment as well, even if the printer engine stops, the accumulated amounts of toner in the accumulated toner amount storage registers can be notified to the printer engine controller 2200, without counting toner amounts of image areas in which toner has not been actually consumed, that is, without degradation of the accuracy of the accumulated toner amount values.

It should be noted that the present invention is not limited to the embodiments described above. For example, in the second embodiment, it is also possible to provide a single register for a single color corresponding to the halftone processing types as in the first embodiment, without providing the plurality of registers (n) for the single color corresponding to the halftone processing types.

In this case, a strobe signal is activated a plurality of times in the course of scanning a single page and the toner amounts at the time points of activation of the strobe signal are sequentially caused to overwrite the amount in the register, and when the printer engine stops suddenly due to a malfunction, the strobe signal is inhibited from being activated, and after transfer of image data for one page has been completed, the accumulated toner amount in the register is read out and sent to the printer engine controller 2200.

Moreover, although in the first and second embodiments the printer engine controller 2200 notifies the controller

1001 only of a malfunction whenever the printer engine stops suddenly due to a malfunction, the printer engine controller 2200 may also notify the controller 1001 of the number of lines that is the count value of the line counter 8011 at the time the emergency stop occurs.

Moreover, alternatively to the arrangement in which the controller 1001 that performs video count processing or the like is built into the image forming apparatus 2001, the controller 1001 may be provided in an external controller or host computer of an information processing apparatus that supplies image data to a printer engine controller having the same capabilities as the controller 1001. In this case, the external controller or host computer need not necessarily be connected directly to the image forming apparatus via a cable such as a USB cable but may instead be connected to the image forming apparatus through a communication line such as a LAN or a public network (including the Internet). It should be noted that processes performed by the external controller or host computer are the same as the processes described above with respect to FIGS. 14 to 18 and FIGS. 21 to 23, and therefore a description thereof is omitted.

Further, it is to be understood that the object of the present invention may also be accomplished by supplying a system or an apparatus with a storage medium (or a recording medium) in which a program code of software which realizes the functions of either of the above described embodiments is stored, and causing a computer (or CPU or MPU) of the system or apparatus to read out and execute the program code stored in the storage medium.

In this case, the program code itself read from the storage medium realizes the functions of either of the above described embodiments, and hence the program code and a storage medium on which the program code is stored constitute the present invention.

Examples of the storage medium for supplying the program code include a floppy (registered trademark) disk, a hard disk, an optical disk, a magnetic-optical disk, a CD-ROM, a CD-R, a CD-RW, DVD-ROM, a DVD-RAM, a DVD–RW, a DVD+RW, a magnetic tape, a nonvolatile memory card, and a ROM. Alternatively, the program may be downloaded via a network.

Moreover, it is to be understood that the functions of either of the above described embodiments may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code. In the case where the present invention is applied to the storage medium described above, the program code corresponding to the flow charts described above are stored in the storage medium.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of either of the above described embodiments may be accomplished by writing the program code read out from the storage medium into a memory provided in an expansion board inserted into a computer or a memory provided in an expansion unit connected to the computer and then causing a CPU or the like provided in the expansion board or the expansion unit to perform a part or all of the actual operations based on instructions of the program code.

CROSS REFERENCE TO RELATED APPLICATION

This application claims priority from Japanese Patent Application No. 2003-329136 filed Sep. 19, 2003, which is hereby incorporated by reference herein.

What is claimed is:

1. An image forming apparatus comprising:

an image forming device that performs a process using a consumable material;

a first controller that controls said image forming device;

a transfer controller that provides control to transfer externally input image data to said first controller; and a second controller that performs a count process for counting an amount of the consumable material to be consumed based on the image data transferred by said transfer controller, wherein said second controller disables the count process without stopping transfer by said transfer controller when the process performed by said image forming device is interrupted.

2. An image forming apparatus as claimed in claim 1, wherein said second controller sets predetermined fixed value data as data to be transferred by said transfer controller in place of the input image data to inhibit the count process based on the input image data from being performed.

3. An image forming apparatus as claimed in claim 2, wherein the fixed value data comprises data corresponding to white.

4. An image forming apparatus as claimed in claim 1, further comprising a storage device, and a notifying device, and wherein:

said second controller separately counts amounts of the consumable material to be consumed corresponding respectively to a plurality of color image data based on the input image data;

said storage device stores the separately counted amounts of the consumable material to be consumed corresponding respectively to the plurality of color image data; and said notification device notifies said first controller of the amounts of the consumable material to be consumed stored in said storage device when the process performed by said image forming device is interrupted.

5. An image forming apparatus as claimed in claim 1, further comprising a halftone processing device that performs different halftone processes depending on a type of the input image data, and wherein said second controller counts the amount of the consumable material to be consumed based on a selected one of the halftone processes and the image data transferred by said transfer controller.

6. An image forming apparatus as claimed in claim 5, wherein said second controller switches the halftone processes based on characteristics information that changes with each pixel of the image data transferred by said transfer controller.

7. An image forming apparatus as claimed in claim 1, further comprising a notification device that notifies said first controller of results of the count process performed by said second controller, and wherein said first controller performs a consumable material replenishment process based on the notification by said notification device.

8. An image forming apparatus as claimed in claim 1, further comprising an image processing device that performs image processing on the externally input image data, and wherein said second controller counts the amount of the consumable material to be consumed based on the externally input image data before being subjected to the image processing by said image processing device.

9. An image forming apparatus as claimed in claim 1, wherein said image processing device comprises an adjustment device that corrects image data based on environment, and said second controller counts the amount of the consumable material to be consumed based on the externally input image data before being subjected to the correction by said adjustment device.

10. An image forming apparatus as claimed in claim 1, wherein said image forming device comprises a printer engine, and said first controller controls said printer engine, and said second controller supplies image data to said printer engine.

11. An image forming apparatus as claimed in claim 1, wherein said transfer controller transfers the image data by DMA (Direct Memory Access) transfer.

* * * * *